US006111345A

United States Patent [19]

Shibata et al.

[11] Patent Number: 6,111,345

[45] Date of Patent: Aug. 29, 2000

[54] SPARK PLUG FOR APPARATUS FOR DETECTING ION CURRENT WITHOUT GENERATING SPIKE-LIKE NOISE ON THE ION CURRENT

[75] Inventors: Masamichi Shibata, Toyota; Toshiaki Yamaura, Anjo, both of Japan

[73] Assignee: Denso Corporation, Japan

[21] Appl. No.: 08/919,443

[22] Filed: Aug. 28, 1997

[30] Foreign Application Priority Data

| | | | |
|---|---|---|---|
| Aug. 29, 1996 | [JP] | Japan | 8-228724 |
| Aug. 29, 1996 | [JP] | Japan | 8-228725 |
| Sep. 20, 1996 | [JP] | Japan | 8-250297 |
| Mar. 14, 1997 | [JP] | Japan | 9-060946 |
| Aug. 6, 1997 | [JP] | Japan | 9-211949 |
| Aug. 6, 1997 | [JP] | Japan | 9-211950 |
| Aug. 6, 1997 | [JP] | Japan | 9-211951 |

[51] Int. Cl.[7] ..... H01T 13/20

[52] U.S. Cl. ..... 313/141; 313/141; 313/140; 313/143

[58] Field of Search ..... 313/140, 141, 313/130, 144, 145, 36; 123/634

[56] References Cited

U.S. PATENT DOCUMENTS

| | | | |
|---|---|---|---|
| 2,499,823 | 3/1950 | Gogel | 313/141 |
| 5,271,268 | 12/1993 | Ikeuchi et al. | 73/115 |
| 5,406,242 | 4/1995 | Klocinski et al. | 123/634 |

FOREIGN PATENT DOCUMENTS

| | | |
|---|---|---|
| 4-191465 | 7/1992 | Japan . |
| 5-71459 | 3/1993 | Japan . |
| 5-71499 | 3/1993 | Japan . |

*Primary Examiner*—Michael H. Day
*Assistant Examiner*—Joseph Williams
*Attorney, Agent, or Firm*—Nixon & Vanderhye

[57] ABSTRACT

In a spark plug having a generally cylindrically shaped metallic body, a generally cylindrically shaped insulator held in the metallic body, a center electrode held in the insulator, and a ground electrode facing the center electrode, the insulator has a ramp portion on an outside surface thereof and the metallic body has a supporting portion for supporting the ramp portion of the insulator. Further, a conductive layer (a protection layer) is formed on the surface of the insulator to face the supporting portion of the metallic body. Accordingly, a corona discharge in a clearance between the supporting portion of the metallic body and the insulator is prevented, so that spike-like noise can be prevented.

58 Claims, 27 Drawing Sheets

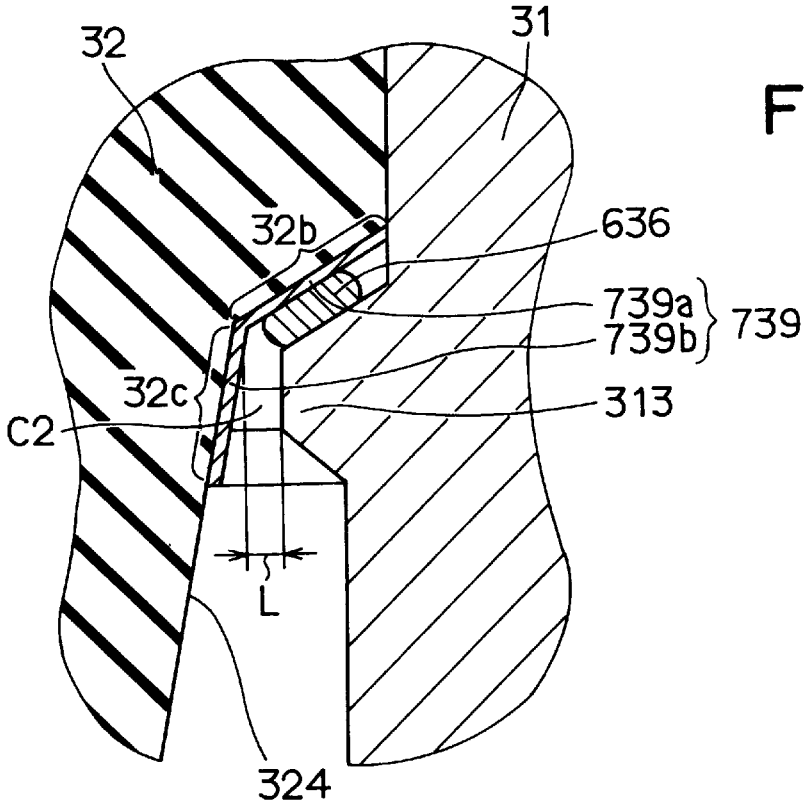
FIG. 17
FIG. 18
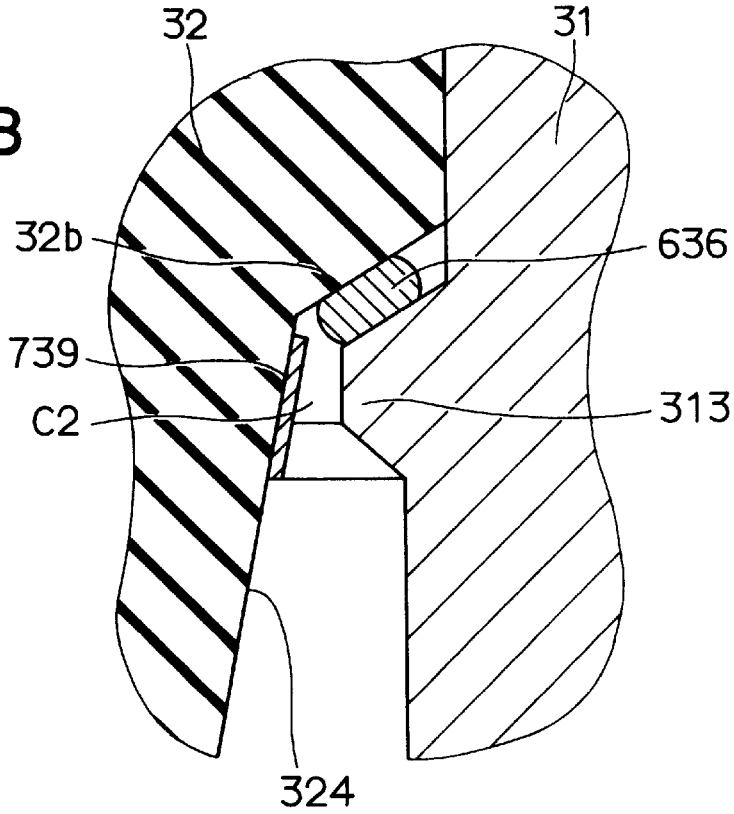

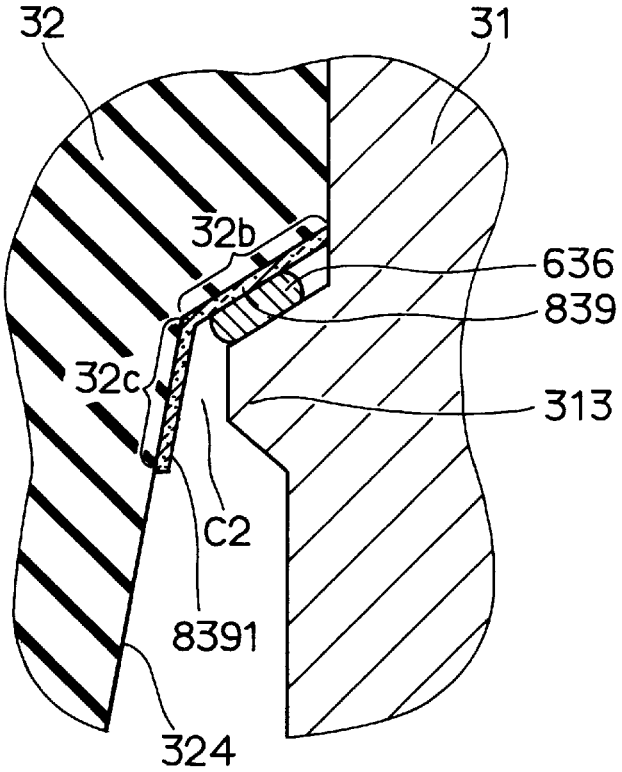
FIG. 19
FIG. 20
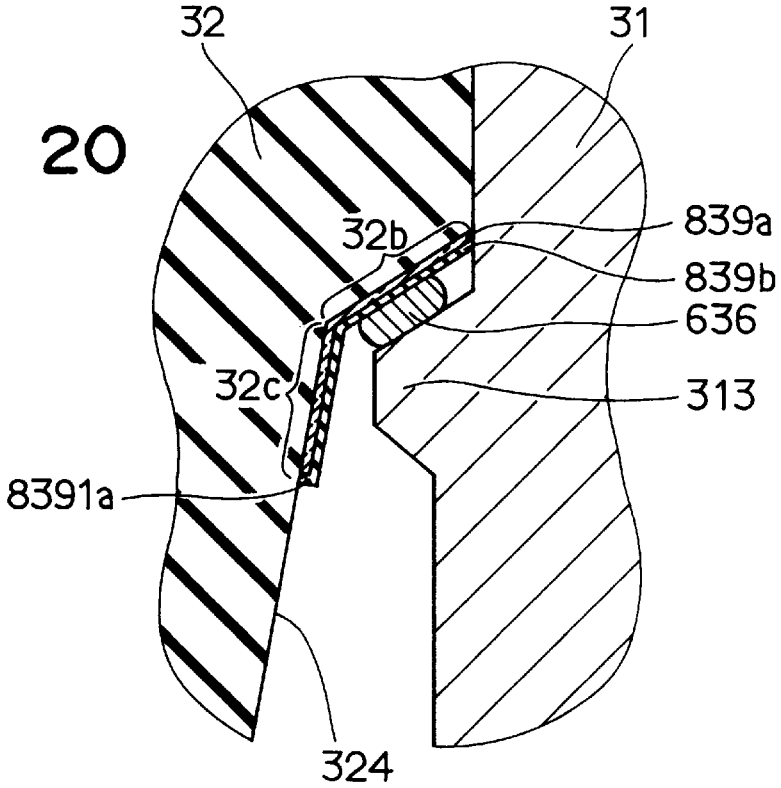

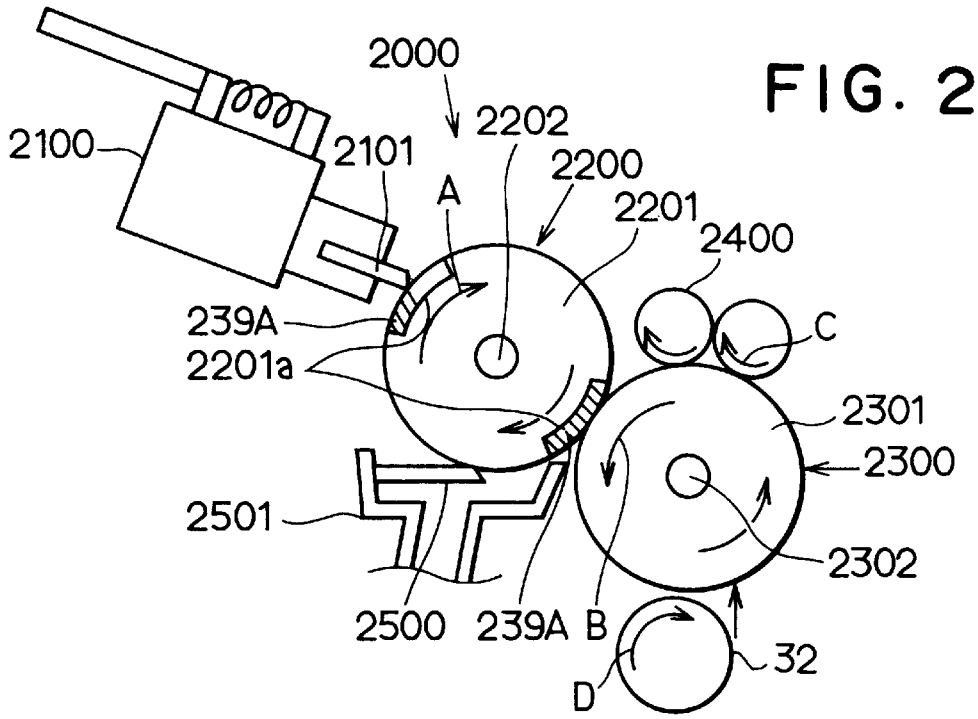
FIG. 28
FIG. 29A
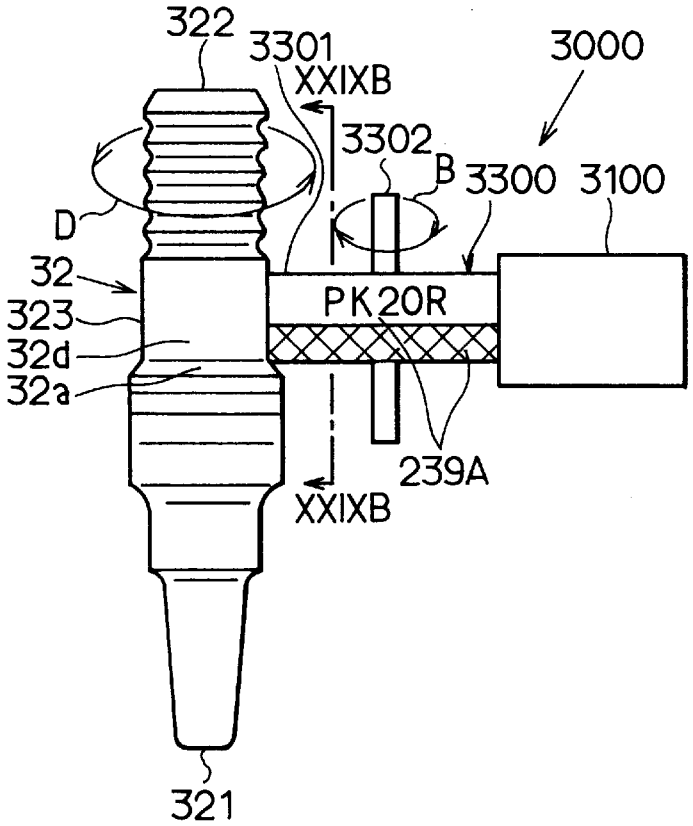
FIG. 29B
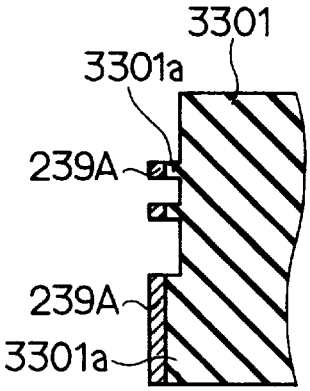

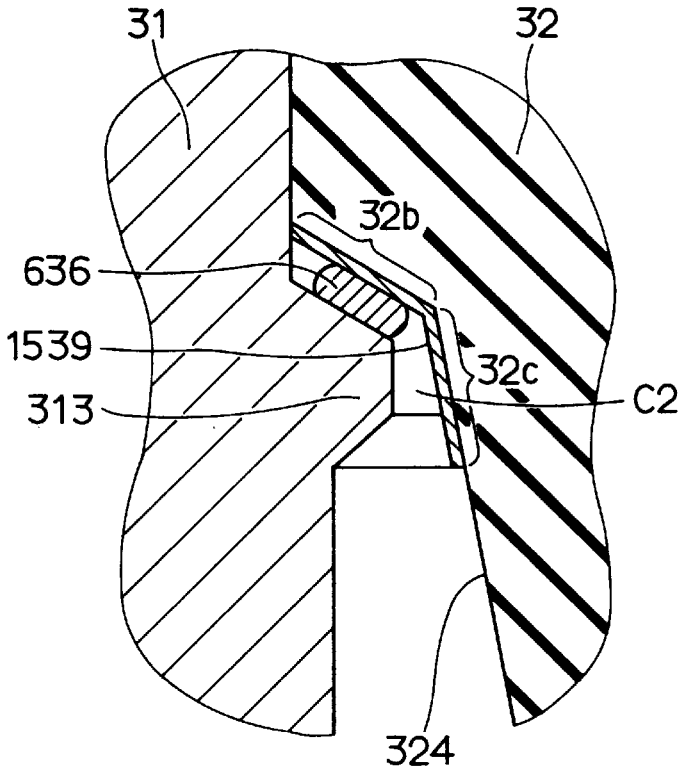
FIG. 33
FIG. 34
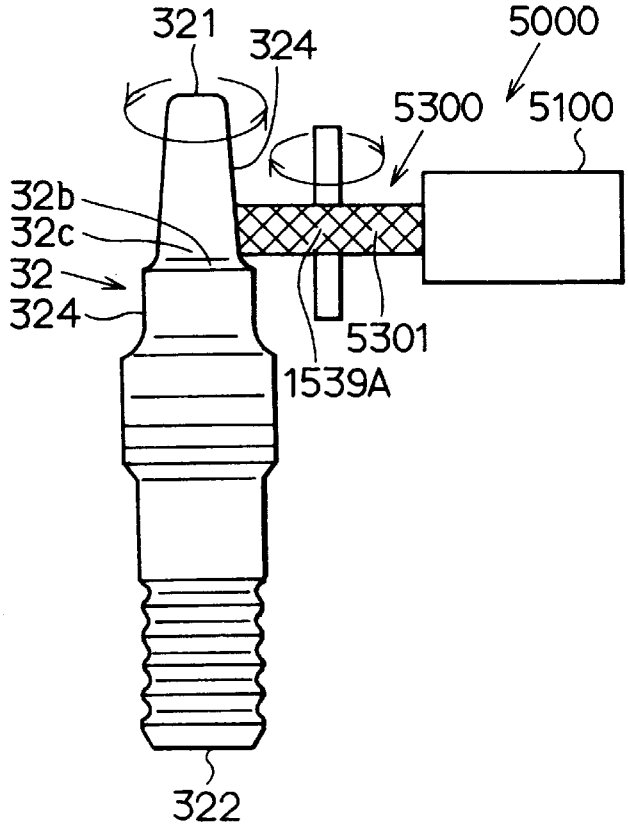

SPARK PLUG FOR APPARATUS FOR DETECTING ION CURRENT WITHOUT GENERATING SPIKE-LIKE NOISE ON THE ION CURRENT

CROSS REFERENCE TO RELATED APPLICATIONS

This application is based upon and claims the benefit of priority-of the prior Japanese Patent Applications No. 8-228757 filed on Aug. 29, 1996, No. 8-228724 filed on August 29, No. 8-250297 filed on Sep. 20, 1996, No. 9-60946 filed on Mar. 14, 1997, No. 9-211949, filed on Aug. 6, 1997, No. 9-211950, filed on Aug. 6, 1997, and No. 9-211951, filed on Aug. 6, 1997, the contents of which are incorporated herein by reference.

BACKGROUND OF THE INVENTION

1. Field of the Invention

The present invention relates to a spark plug for an apparatus for detecting an ion current without generating spike-like noise on the ion current.

2. Related Arts

A conventional spark plug 3 for an ion current detecting apparatus for detecting an ion current as shown in FIG. 1, has a cylindrically shaped insulator 32, a cylindrically shaped metallic body 31 retaining the insulator 32 therein, and a center electrode 33 and a stem portion 34 retained in the insulator 32. Further, a ground electrode 35 is fixed to an end portion 311 of the metallic body 31 to face the end portion 331 of the center electrode 33 through a discharge gap 38. The insulator 32 has a ramp portion 32*a* at a portion corresponding to the other end portion 312 of the metallic body 31 and a small diameter portion 323 on the side of the end portion 322 thereof (on the upper side in FIG. 1) with respect to the ramp portion 32*a*. The metallic body 31 is fixed to the insulator 32 by caulking the end portion 312 thereof along the ramp portion 32*a* of the insulator 32.

To operate the spark plug 3, the end portion 3*b* of the spark plug 3 having the ground electrode 35 and the center electrode 33 is inserted into a combustion chamber of an internal combustion engine and a high voltage of approximately 10 kV to 35 kV is delivered to the spark plug 3. Accordingly, a spark discharge occurs between the ground electrode 35 and the center electrode 33 in the discharge gap 38 so that an air-fuel mixture in the combustion chamber is ignited. The burning of the air-fuel mixture is accompanied by electrolytic dissociation to generate ions, so that ion current flows between the center electrode 33 and the ground electrode 35 (that is, the metallic body 31). Recently, detecting the burning state of the air-fuel mixture in the combustion chamber and knocking of the engine by detecting the ion current has been studied. The ion current is usually detected by an ion current detecting apparatus.

The waveform of the ion current detected by the ion current detecting apparatus is shown in FIG. 2. Generally, when the ion current detecting apparatus detects an ion current having an waveform including a build-up portion with a rise height of H and rise duration of more than a specific duration T, it is judged that the air-fuel mixture is burning. When the burning of the air-fuel mixture stops, the ion current is not generated, so that the above-mentioned build-up portion is not detected. Just before the air-fuel mixture is ignited, the ions are generated in the discharge gap 38 so that the build up of the ion current is detected. An oscillating waveform K of the ion current shown in FIG. 2 occurs in response to the knocking of the engine, thereby detecting the knocking of the engine to control the timing of igniting the air-fuel mixture.

However, when spike-like noise N shown in FIG. 2 is generated on the waveform of the ion current, the spike-like noise N is likely to cause a false detection by the ion current detecting apparatus. For example, the ion current detecting apparatus is likely to judge the spike-like noise N as the oscillating waveform K, thereby resulting in misjudgment that the knocking of the engine is generated. In a full-open state of a throttle valve of the engine, the pressure in the combustion chamber is high in comparison with the full-closed state of the throttle valve, so that the required voltage applied to the spark plug 3 becomes high. In this case, the spike-like noise N is frequently generated on the ion current. Thus, the ion current detecting apparatus has a tendency to make the false detection frequently in the full-open state of the throttle valve.

SUMMARY OF THE INVENTION

The present invention has been made in view of the above-mentioned problems and an object of the present invention is to provide a spark plug for an apparatus for detecting an ion current without producing spike-like noise on the waveform of the ion current.

The inventors of the present invention have studied and found out that when a high voltage is applied to a spark plug, concentration of electric field occurs not only in a discharge gap thereof but also in a clearance C1 shown in FIG. 1 to cause a corona discharge, and the corona discharge produces a positive charge to cause spike-like noise.

According to the present invention, in a spark plug having a generally cylindrically shaped metallic body, a generally cylindrically shaped insulator held in the metallic body, a center electrode held in the insulator, and a ground electrode facing the center electrode, the insulator has a ramp portion on an outside surface thereof and the metallic body has a supporting portion for supporting the ramp portion of the insulator. Further, a protection layer is formed on the surface of the insulator to face the supporting portion of the metallic body.

In a case where the supporting portion includes a first end of the metallic body, the protection layer can fill a gap between the first end of the metallic body and the outside surface of the insulator. In such case, it is preferable that the protection layer is made of insulating material having dielectric constant and dielectric strength, one of which is larger than that of air. Further, it is preferable that the material for forming the protection layer be in a solid state or in a liquid state to not include air therein. Accordingly, the intensity of the electric field produced in the gap between the first end of the metallic body and the outside surface of the insulator is reduced and dielectric strength therebetween is increased, so that the corona discharge therebetween can be prevented. Otherwise, the protection layer may be a conductive layer to eliminate a portion where the corona discharge is liable to occur. In this case, it is preferable that the protection layer has a resistance of in a range of $10^5$ Ω to $10^{10}$ Ω per square inch when thickness thereof is approximately 20 μm. If the resistance of the conductive layer having the thickness of approximately 20 μm is smaller than $10^5$ Ω per square inch, the above-mentioned effect is suppressed. On the other hand, if the value of resistance of the conductive layer having the thickness of approximately 20 μm is larger than $10^{10}$ Ω per square inch, the manufacturing performance of the protection layer is deteriorated.

The protection layer may be a conductive layer to make a clearance with the supporting portion of the metallic body. In this case, even if the corona discharge occurs to produce a positive charge, the positive charge is dispersed to the entire surface of the conductive layer. As a result, the positive charge is prevented from suddenly flowing into the metallic body to cause spike-like noise. When the conductive layer is formed to encircle the insulator, the above-mentioned effect is further enhanced. In a case where the conductive layer is electrically connected to the metallic body, the positive charge flows into the metallic body little by little, so that the occurrence of the spike-like noise is further suppressed. Accordingly, a false detection by an ion current detecting apparatus can be prevented.

The conductive layer may include a glass-system insulating material. The resistance of the conductive layer is preferably in a range of $10^5$ Ω to $10^{10}$ Ω per square inch in the chase where the thickness thereof is approximately 20 μm. When the resistance of the conductive layer having the thickness of approximately 20 μm is larger than $10^5$ Ω per square inch, the concentration of the electric field around the end of the conductive layer can be prevented. Further, to obtain the effect of dispersing the positive discharge, it is preferable that the resistance of the conductive layer having the thickness of approximately 20 μm is smaller than $10^{10}$ Ω per square inch. More preferably, the resistance of the conductive layer having the thickness of approximately 20 μm is in a range of $10^6$ Ω to $10^9$ Ω per square inch to sufficiently obtain the above-mentioned effects. On the other hand, the end of the conductive layer, which is exposed to air so that the electric field is liable to concentrate around the end, can be covered with an insulating member. In this case, the conductive layer need not have the lower limit of the resistance thereof. Therefore, in this case, it is possible that conductive material, the resistance of which is approximately zero, such as Ag, Au, Cu, Ni or the like, can be used for the conductive layer.

The insulator having the ramp portion has a small diameter portion on an end side thereof with respect to the ramp portion, and the conductive layer is preferably formed on the small diameter portion to face the supporting portion of the metallic body and to have a length in an axial direction thereof more than 2 mm. The conductive layer may be formed on the ramp portion, and may be extended to the opposite direction of the small diameter portion with respect to the ramp portion by a specific length.

BRIEF DESCRIPTION OF THE DRAWINGS

Other objects and features of the present invention will become more readily apparent from a better understanding of the preferred embodiments described below with reference to the following drawings.

FIG. 17 is a partially enlarged cross-sectional view showing a conductive layer of the spark plug in the seventh embodiment;

FIG. 18 is a partially enlarged cross-sectional view showing a modified conductive layer of the spark plug in the seventh embodiment;

FIG. 19 is a partially enlarged cross-sectional view showing a conductive layer of a spark plug in an eighth preferred embodiment according to the present invention;

FIG. 20 is a partially enlarged cross-sectional view for explaining a process of forming the conductive layer of the spark plug in the eighth embodiment;

FIG. 28 is an upper view showing the printing machine utilized in the twelfth embodiment;

FIG. 29A is a front view showing a printing machine utilized in a thirteenth preferred embodiment according to the present invention;

FIG. 29B is a cross-sectional view taken along a XXIXB—XXIXB line in FIG. 29A, showing a transfer roller of the printing machine utilized in the thirteenth embodiment;

FIG. 33 is a partially enlarged cross-sectional view showing a conductive layer of the spark plug in the fifteenth embodiment;

FIG. 34 is a front view showing a printing machine utilized in the fifteenth embodiment;

DETAILED DESCRIPTION OF THE PREFERRED EMBODIMENTS

Figure 1:
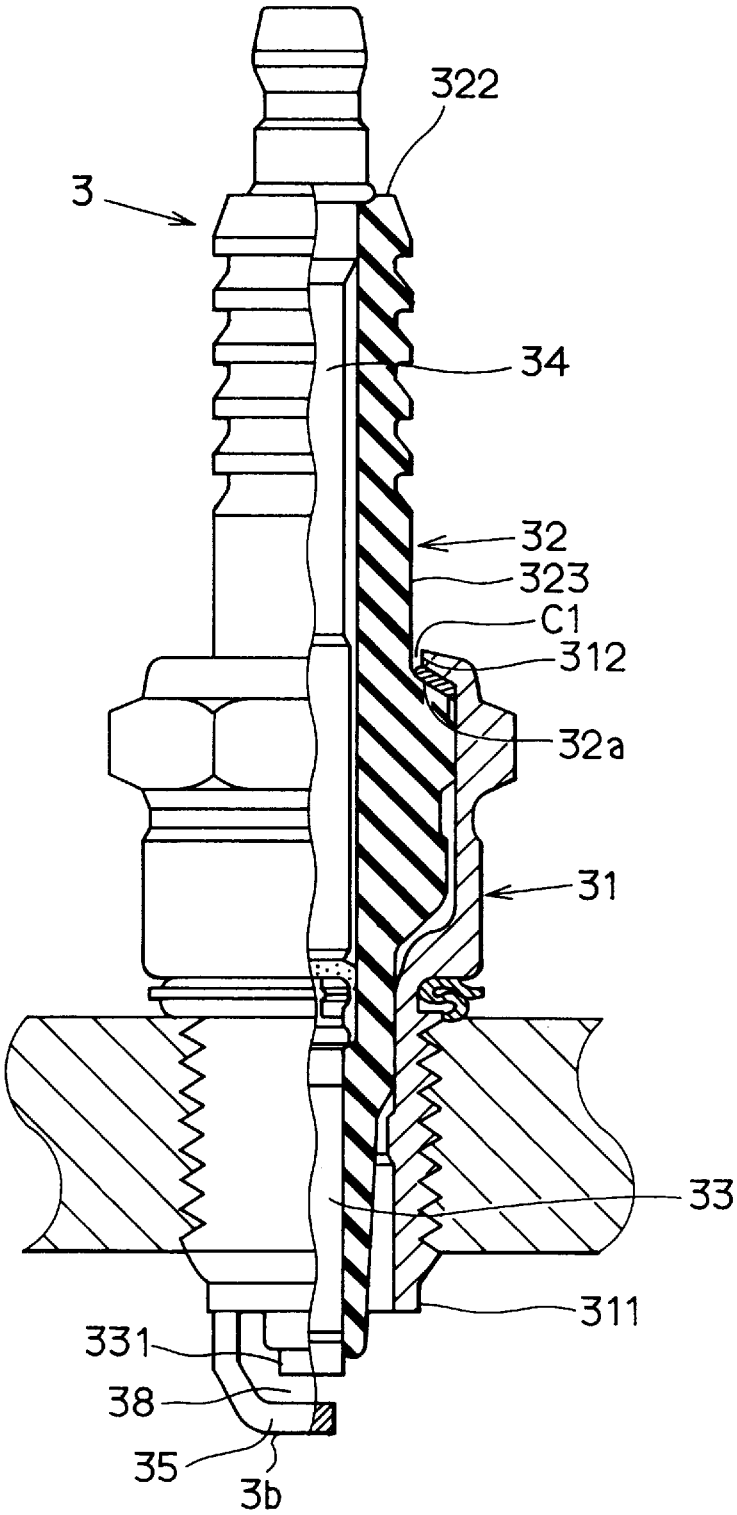
FIG. 1 PRIOR ART
FIG. 1 is a partial cross-sectional view showing a spark plug according to the prior art.
Figure 2:
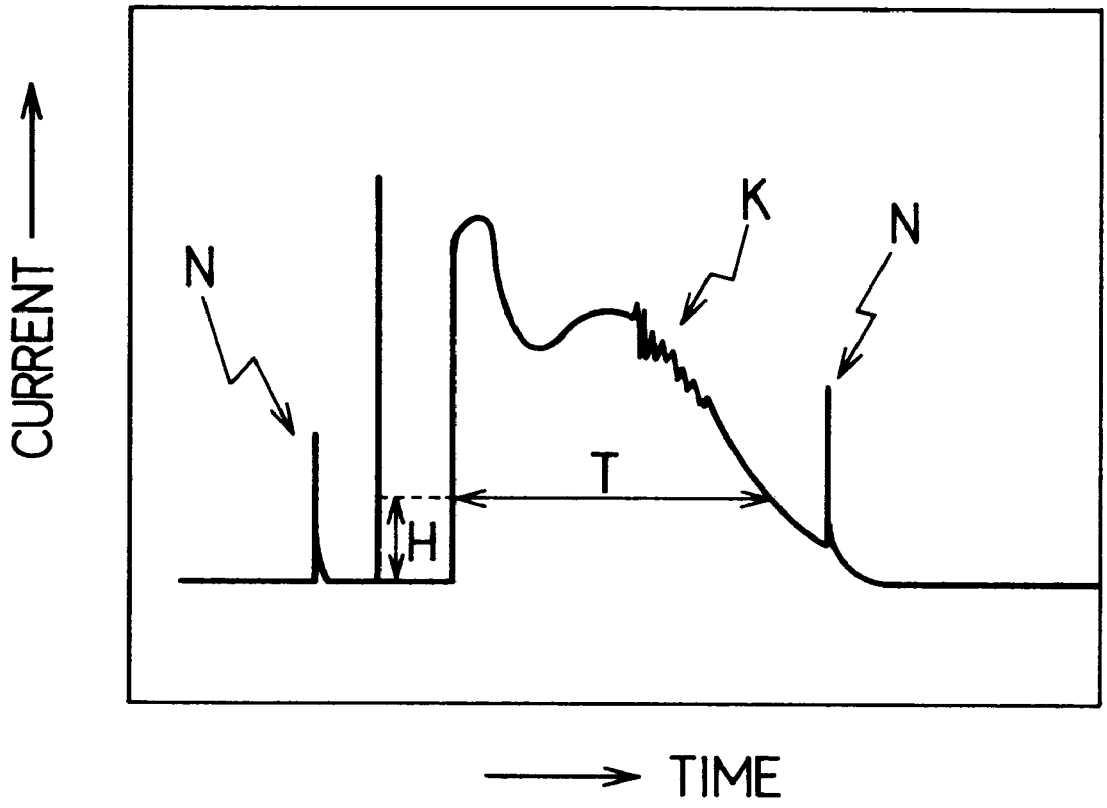
FIG. 2 PRIOR ART
FIG. 2 is a graph showing waveform of an ion current detected by an ion current detecting apparatus in the prior art.

Embodiments according to the present invention will be described hereinunder with reference to the drawings. In the embodiments, the parts and components similar to those in the prior art shown in FIG. 1 are shown by the same reference numerals and description thereof will be omitted.

First Embodiment

Figure 3:
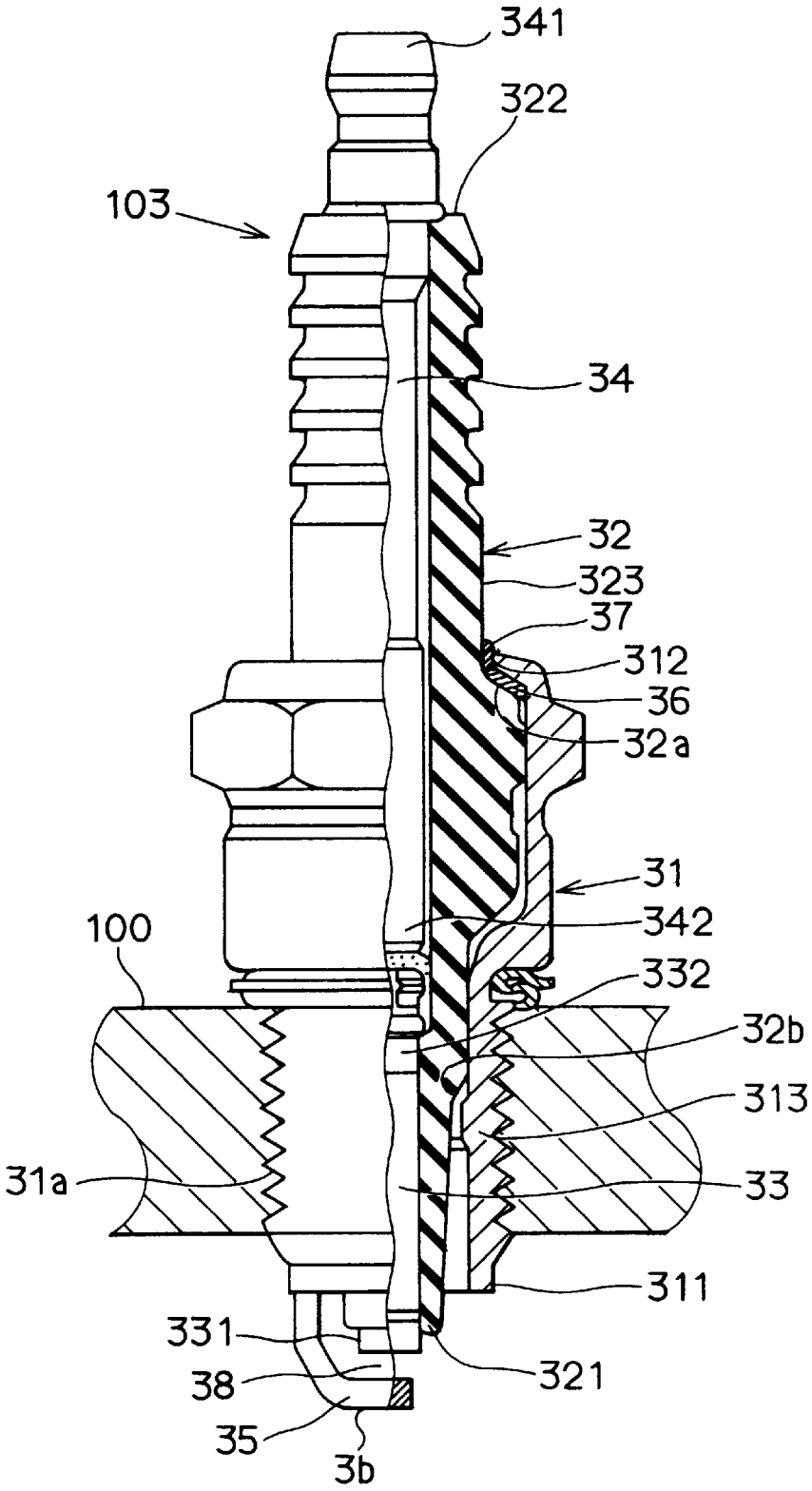
FIG. 3 is a partial cross-sectional view showing a spark plug in a first preferred embodiment according to the present invention.

In a first preferred embodiment, as shown in FIG. 3, a metallic body 31 of a spark plug 103 has a threaded portion 31*a* to be fixed to an engine block 100 and retains an insulator 32 therein so that the end portions 321 and 322 of the insulator 32 respectively protrude from the end portions 311 and 312 of the metallic body 31. Further, a center electrode 33 and a stem portion 34 are held and fixed in the insulator 32. The end portion 331 of the center electrode 33 protrudes from the end portion 321 of the insulator 32 and the end portion 341 of the stem portion 34 protrudes from the other end portion 322 of the insulator 32. On the other hand, the other end portion 332 of the center electrode 33 is electrically connected to the other end of the stem portion 34 through a thermal fusing member within the insulator 32.

The end portion 312 of the metallic body 31 and the vicinity thereof is fixed to a ramp portion 32*a* of the insulator 32 via a packing 36 made of material having high heat resistivity such as iron, copper or the like. The packing 36 has a shape corresponding to the clearance between the ramp portion 32*a* of the insulator 32 and the end portion 312 of the metallic body 31 and the vicinity thereof. Further, the insulator 32 has another ramp portion 32*b* on the side of the end portion 321 thereof with respect to the ramp portion 32*a*. The ramp portion 32*b* is supported by a supporting portion 313 of the metallic body 31. The supporting portion 313 is formed on the inside surface of the metallic body 31 to encircle the inside surface. The clearance between the ramp portion 32*b* of the insulator 32 and the supporting portion 313 of the metallic body 31 is also sealed by a packing which is not shown.

Figure 4:
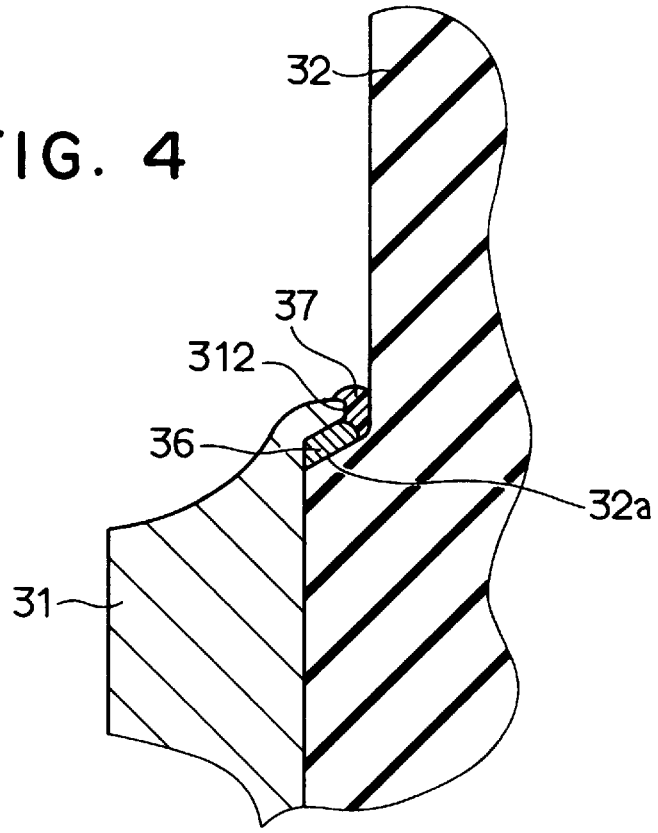
FIG. 4 is a partially enlarged cross-sectional view showing a filling layer of the spark plug in the first embodiment.

To fix the metallic body 31 to the ramp portion 32*a* of the insulator 32, first, the insulator 32 is inserted into the metallic body 31 from the side of the end portion 312 and the packing 36 is disposed on the ramp portion 32*a* of the insulator 32. Thereafter, the end portion 312 of the metallic body 31 and the vicinity thereof is caulked bending inwardly, so that the packing 36 is pressed to deform between the end portion 312 and the ramp portion 32*a*. In this way, the end portion 312 of the metallic body 31 and the vicinity thereof is fixed to the insulator 32 via the packing 36. Further, as shown in FIG. 4, the clearance defined by the end portion 312 of the metallic body 31 and the vicinity thereof, the packing 36 and the insulator 32 is filled with silicone resin having a dielectric constant higher than that of air and a high dielectric strength, thereby forming a filling layer (a protection layer) 37 along the circumference of the insulator 32. Actually, the silicone resin has a dielectric constant of approximately 3 and a dielectric strength of approximately 50 kV/mm–60 kV/mm. Accordingly, the intensity of the electric field produced between the end portion 312 of the metallic body 31 and the insulator 32 is reduced and the dielectric strength therebetween is increased, thereby preventing dielectric breakdown therebetween which causes a corona discharge. As a result, spike-like noise generated on a waveform of an ion current of the spark plug 103 can be suppressed.

Figure 5:
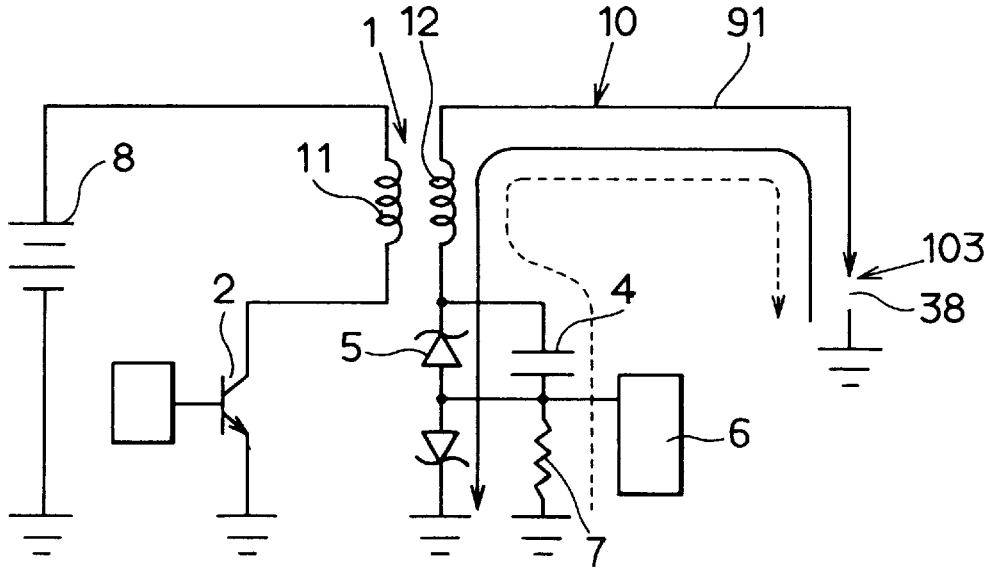
FIG. 5 is a circuit arrangement of an ion current detecting apparatus in the first embodiment.

The spark plug 103 was installed in a combustion chamber of an automotive internal combustion engine having a displacement of 1800 cc and 4 cylinders. In a full-open state of a throttle valve of the engine (at an engine speed of 2000 rpm), the voltage generated in a resistor 7 shown in FIG. 5 provided in the ion current detecting apparatus 10 was detected for 500 cycles. Here, the ion current is obtained from the voltage of the resistor 7. That is, when the voltage of the resistor 7 has spike-like noise thereon, it means that the ion current of the spark plug 103 has spike-like noise. The detailed explanation concerning the resistor 7 and the ion current detecting apparatus will be made later. According to this experiment, it was confirmed that no spike-like noise occurred on the waveform of the detected voltage.

In the first embodiment, for example, a liquid including silicone resin in an organic solvent or the like is injected into the space defined by the end portion 312 of the metallic body 31, the insulator 32, and the packing 36 using a syringe or the like, and then is dried, whereby the filling layer 37 is formed. In this way, the spark plug 103 in the first embodiment can be obtained by the easy process, thereby resulting in low manufacturing cost.

The reason why the spike-like noise is prevented in this embodiment is explained in the following way. In the conventional spark plug 3 shown in FIG. 1, the clearance C1 having a small width (0.4 mm, for example) is defined between the end portion 312 of the metallic body 31 and the small diameter portion 323 of the insulator 32. The clearance C1 is provided so that the end portion 312 and the small diameter portion 323 do not interfere each other when the metallic body 31 is fixed to the insulator 32 by a caulking method and so that the end portion 32 of the metallic body 31 and the vicinity thereof cover the ramp portion 32*a* of the insulator 32 to have an overlapped width in the radial direction of the insulator 32 as long as possible.

On the other hand, a high voltage of several tens of kilovolts is applied to the metallic body 31 and the center electrode 33. In the conventional spark plug 3, however, the clearance C1 between the end portion 312 of the metallic body 31 and the insulator 32 is filled with air having a small dielectric constant compared to the insulator 32. Therefore, the intensity of the electric field produced in the clearance C1 is larger than that of the electric field produced in the insulator 32. In addition, the dielectric strength of air is smaller than that of the insulator 32. Therefore, dielectric breakdown easily occurs in the clearance C1 to cause the corona discharge in the clearance C1. As a result, positive charges are produced in the clearance C1. Here, the dielectric constant of air is generally one ninth that of the insulator 32, and the dielectric strength of air at around 20° C. is generally 2 kV/mm–3 k/mm, while those of dielectric materials are around 20 kV/mm at around 20° C.

In the spark plug 3, the center electrode 33 functions as a cathode and the metallic body 31 functions as an anode, whereby the insulator 32 is polarized to have outer and inner surface sides thereof which respectively have negative and positive electrical potentials. Therefore, the positive charge produced due to the corona discharge is drawn toward the outer surface of the insulator 32 and is locally accumulated thereon. The reasons why the positive charge is locally accumulated on the surface of the insulator 32 is because the surface of the insulator 32 has irregularities, the width of the clearance C1 has variations, and the like. The thus accumulated positive charge flows into the metallic body 31 in response to external factors such as a change in electric potential of the center electrode 33 and the like. Especially, when a large amount of the positive charge is accumulated on the insulator 32 and suddenly flow into the metallic body 31, the spike-like noise is generated on the waveform of the voltage.

As opposed to this, in the first embodiment, the clearance C1 between the end portion 312 of the metallic body 31 and the vicinity thereof and the insulator 32 is filled with the filling layer 37. Further, the filling layer 37 is made of silicone resin having the high dielectric constant and dielectric strength. Accordingly, the intensity of the electric field produced between the metallic body 31 and the insulator 32 is reduced and the dielectric strength is increased, so that the dielectric breakdown therebetween which causes the corona discharge can be prevented. As a result, any spike-like noise does not occur on the waveform of the voltage detected by the ion current detecting apparatus 10.

Next, the structure and operation of the ion current detecting apparatus 10 will be explained in more detail referring to FIG. 5. The ion current detecting apparatus 10 includes an ignition coil 1 composed of a primary winding 11 and a secondary winding 12. A power transistor 2 and an on-vehicle electric power source 8 are connected to the primary winding 11 in series. The power transistor 2 interrupts a primary current flowing in the primary winding 11. The spark plug 103 is connected to the secondary winding 12 in series. Further, a capacitor 4 is connected to the secondary winding 12 and the resistor 7 for converting the ion current into voltage is arranged between the capacitor 4 and ground. Further, a diode 5 is in parallel to the resistor 7 and the capacitor 4 to set a charge voltage of the capacitor 4 at will.

At the time when the air-fuel mixture in the combustion chamber is ignited, a high voltage in a range of approximately −10 kV to −35 kV is produced in the secondary winding 12, so that a discharge current flows in a passage indicated by an unbroken arrow in FIG. 5, thereby generating the discharge in a discharge gap 38 of the spark plug 103. As a result, the air-fuel mixture is ignited. Simultaneously, the capacitor 4 is charged with the discharge current. The burning of the air-fuel mixture is accompanied by electrolytic dissociation so that ions are produced. At that time, because the capacitor 4 is charged, the ion current generated by the ions flows in a passage indicated by a dotted arrow in FIG. 5 to generate the voltage in the resistor 7. The voltage generated in the resistor 7 is detected by a computer 6 to detect the ion current. According to the detected voltage, the burning state of the air-fuel mixture in the combustion chamber can be judged. On the basis of the judgment, the computer 6 controls fuel consumption and the timing of igniting the air-fuel mixture, whereby the most suitable burning state of the air-fuel mixture in the combustion chamber is maintained. Here, the ignition coil 1, the power transistor 2 and the on-vehicle electric power source 8 constitute voltage supply means, and the capacitor 4, the computer 6 and the resistor 7 constitute ion current detecting means.

Figure 6:
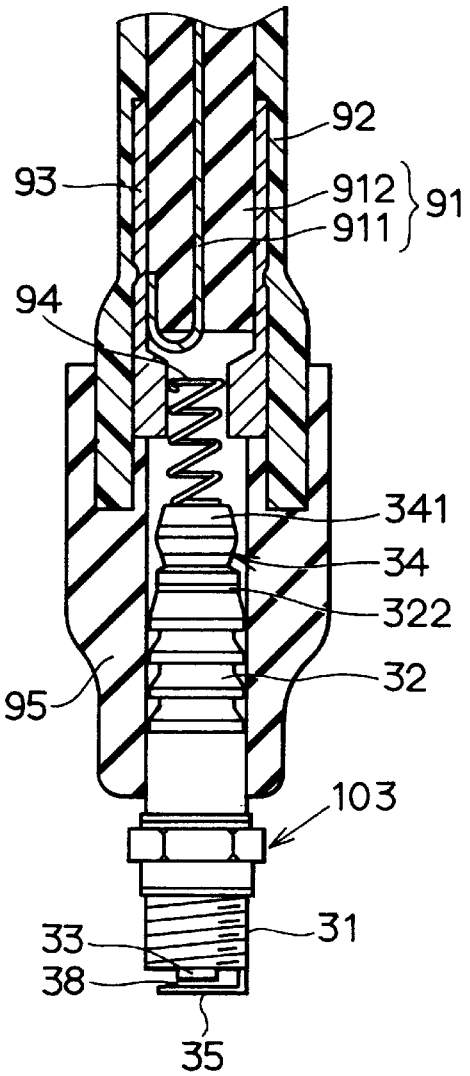
FIG. 6 is a cross-sectional view showing an electrical-connection structure of the spark plug to the ion current detecting apparatus in the first embodiment.

The spark plug 103 and the ignition coil 1 electrically communicate with each other through a lead wire 91 as shown in FIGS. 5 and 6. As shown in FIG. 6, the lead wire 91 is composed of a conductive wire 911 made of conductive material (for example, steel) and an insulating tube 912 made of insulating material (for example, rubber) covering the conductive wire 911. The lead wire 91 is covered with an insulating cap 92 made of insulating material (for example, resin). Further, a conductive cylinder 93 made of conductive material (for example, stainless steel) is disposed between the lead wire 91 and the insulating cap 92 at the end portion of the lead wire 91 to be electrically connected to the spark plug 103. The conductive wire 911 of the lead wire 91 protrudes from the insulating tube 92 at the end of the lead wire 91 and is bent to be interposed between the insulating tube 912 and the conductive cylinder 93. The conductive cylinder 93 is supported by a coil spring 94 contacting the end portion 341 of the stem portion 34. The end of the insulating cap 92 is attached to an end of another insulating cap 95 made of insulating material (for example, rubber), while the other end of the insulating cap 95 is attached to the circumferential portion of the insulator 32 by pressure. Accordingly, the electrical connection between the spark plug 103 and the ignition coil 1 is obtained.

Second Embodiment

Figure 7:
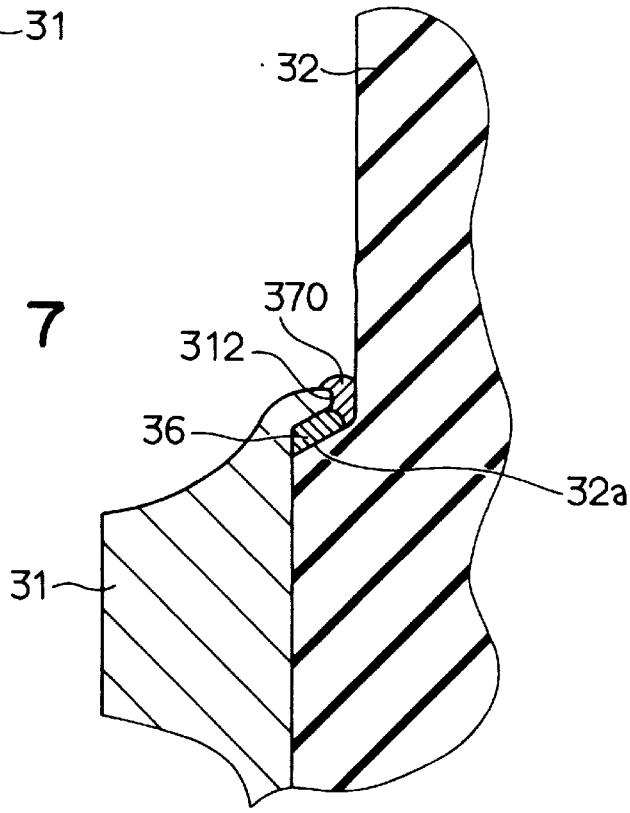
FIG. 7 is a partially enlarged cross-sectional view showing a filling layer of a spark plug in a second preferred embodiment according to the present invention.

In a second preferred embodiment, as shown in FIG. 7, a filling layer 370 made of conductive material such as Ag, Au, Cu, or the like is employed in place of the filling layer 37 in the first embodiment. In a process of forming the filling layer 370, first, powder of Ag, Au, Cu, or the like is mixed with binder material, and then is diluted with an organic solvent to be injected into the space between the end portion 312 of the metallic body 31 and the insulator 32 using a syringe or the like. Thus the filling layer 370 is formed. As a result, the occurrence of corona discharge between the end portion 312 of the metallic body 31 and the insulator 32 can be prevented.

Third Embodiment

Figure 8:
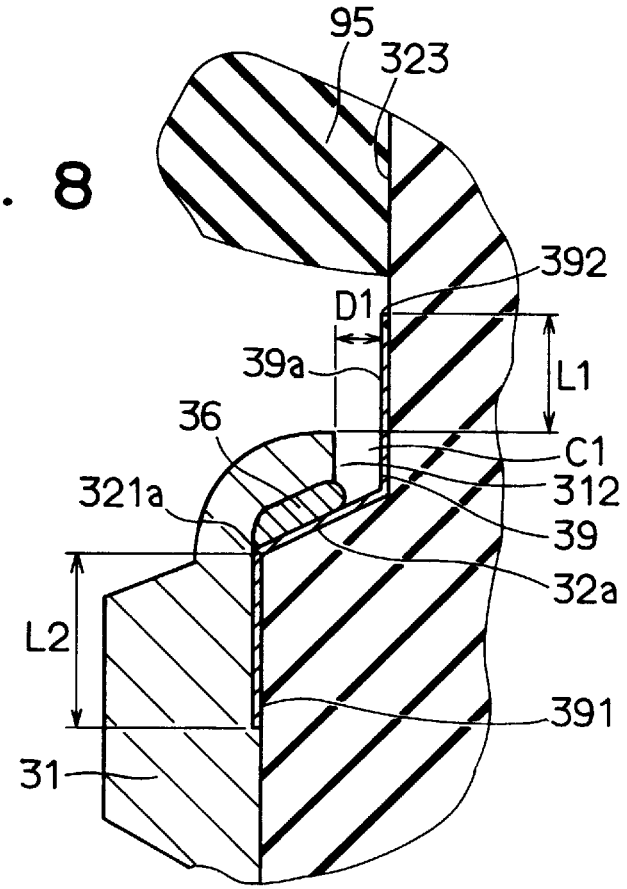
FIG. 8 is a partially enlarged cross-sectional view showing a conductive layer of a spark plug in a third preferred embodiment according to the present invention.

In a third preferred embodiment, as shown in FIG. 8, the insulator 32 has a conductive layer (a protection layer) 39 on the circumferential surface of the ramp portion 32*a* and the vicinity thereof to encircle the portion. The conductive layer 39 has an extending part 39*a* with the end portion 392 thereof formed on the small diameter portion 323 of the insulator 32 and extending from a portion corresponding to the tip of the end portion 312 of the metallic body 31 to the other end portion 392 thereof (on the upper side with respect to the ramp portion 32*a* in FIG. 8). The end portion 392 of the conductive layer 39 is not covered with the insulating cap 95. The conductive layer 39 further includes a part formed on the small diameter portion 323 to face the end portion 312 of the metallic body 31, a part formed on the ramp portion 32*a* of the insulator 32 and partially covered with the metallic body 31 through the packing 36, and a part extending from a shoulder portion 321*a* of the ramp portion 32*a* to the end portion 391 thereof (on the lower side with respect to the ramp portion 32*a* in FIG. 8) and directly covered with the metallic body 31. The conductive layer 39 is electrically connected to the metallic body 31 at the parts covered with the metallic body 31 directly and through the packing 36. In the third embodiment, the extending part 39*a* of the conductive layer 39 has a length L1 of approximately 5 mm in the axial direction of the insulator 32. The part of the conductive layer 39 extending from the shoulder portion 321*a* of the ramp portion 32*a* to the end portion 391 thereof has a length L2 of approximately 1 mm in the axial direction of the insulator 32. Accordingly, the electrical connection between the conductive layer 39 and the metallic body 31 becomes more secure. Here, the width D1 of the clearance C1 between the conductive layer 39 and the end portion 312 of the metallic body 31 in the radial direction of the insulator 32 is approximately 0.4 mm.

The conductive layer 39 is made of ruthenium oxide ($RuO_2$) utilized as a conductive material or a resistive material. Provided that the layer made of $RuO_2$ has a thickness of approximately 20 $\mu$m, the layer has a resistance of $10^8$ Ω per square inch. A paste containing the $RuO_2$ is coated on the circumferential surface of the insulator 32 where the conductive layer 39 is to be formed, and a glaze is coated on the circumferential surface of the insulator 32 except the portion where the paste containing the $RuO_2$ is coated. Thereafter, the paste is burned at a high temperature (for example, 800° C.) for a specific time (for example, 20 minutes), whereby the conductive layer 39 is formed. Because the conductive layer 39 is formed at the above-mentioned high temperature, the burning process is only performed on the insulator 32 on which no part is mounted. The thickness of the conductive layer 39 in the third embodiment is approximately 20 $\mu$m, and it is preferably in a range of 10 $\mu$m to 60 $\mu$m. In a case where the thickness of the conductive layer 39 is too thin, the effect of preventing the spike-like noise is suppressed. To the contrary, in a case where the thickness of the conductive layer 39 is too thick, the manufacturing performance is deteriorated.

The conductive layer 39 can be made of PdAg or the like in the same way as in the case of $RuO_2$. In a case where the conductive layer 39 is made of conductive rubber or conductive resin including conductive material such as carbon or the like, first, a paste including the conductive material and an organic solvent is coated on the circumferential surface of the insulator 32, and then is dried at a room temperature (for example, 25° C.), thereby forming the conductive layer 39.

In this case, regarding the heat resistance of the conductive layer 39, before the conductive layer 39 is formed, a glaze is coated on the circumferential surface of the insulator 32 and is burned at a high temperature.

Figure 9:
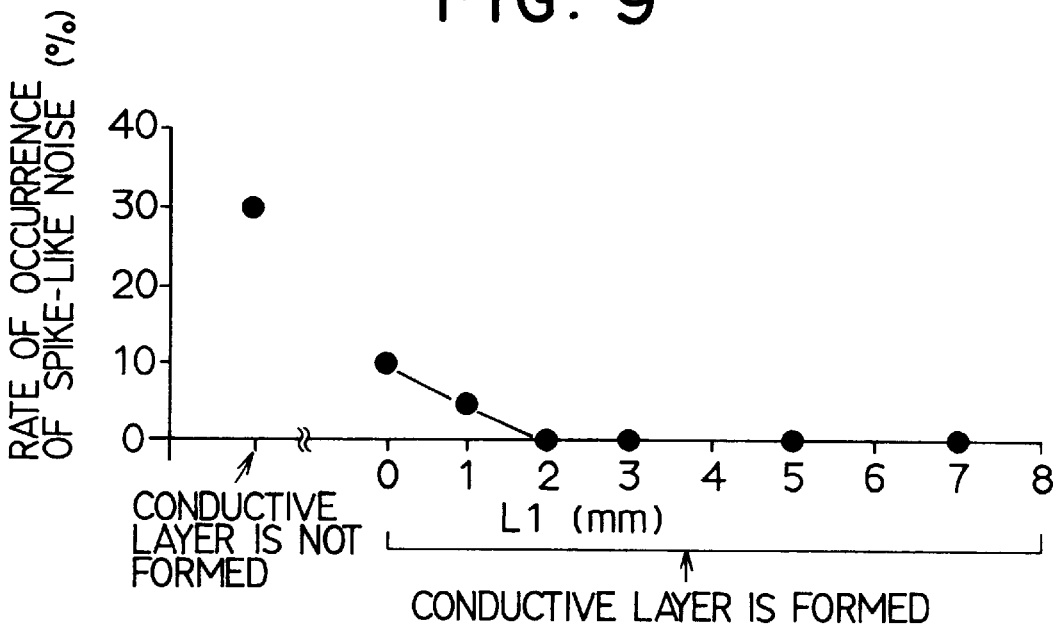
FIG. 9 is a graph showing a relationship between a rate of occurrence of spike-like noise and a length L1 of an extending part of a conductive layer in the third embodiment.

Hereafter, a relationship between the rate of occurrence of the spike-like noise and the length L1 of the extending part 39*a* of the conductive layer 39 in the axial direction thereof will be described referring to FIG. 9. The rate of occurrence of the spike-like noise was obtained from the waveform of the voltage detected by the ion current detecting apparatus 10. The experiment for evaluating the relationship was performed in the following way. First, samples of the spark plug 103 respectively having the conductive layers 39 having the extending parts 39*a* with the lengths L1 of 0 mm, 1 mm, 2 mm, 3 mm, 5 mm, and 7 mm and a sample of the spark plug 103 without the conductive layer 39 were prepared. In the sample having the length L1 of 0 mm, the end portion 392 of the conductive layer 39 and the tip of the end portion 312 of the metallic body 31 were approximately arranged on the same line perpendicular to the axial direction of the insulator 32. Thereafter, the same experiment as in the first embodiment was performed on the samples. As described in the first embodiment, the voltage in response to the ion current of the spark plug 103 was detected from each of the samples for 500 cycles. Accordingly, the rate of occurrence of the spike-like noise of the each of the samples shown in FIG. 9 was obtained. The rate of occurrence was a percentage of the number of the voltage waveforms, each of which corresponds to one cycle and has at least one spike-like noise thereon, relative to 500. As a result, in the case where the conductive layer 39 was not formed, the rate of occurrence of the spike-like noise was approximately 30%. As opposed to this, the rates of occurrence of the spike-like noise of the samples having the conductive layers 39 were less than 10%. Especially, when the length L1 of the extending part 39*a* of the conductive layer 39 was equal to or more than 2 mm, the rate of occurrence of the spike-like noise was substantially zero. That is, it was confirmed that the occurrence of the spike-like noise can be completely prevented when the length L1 of the extending part 39*a* of the conductive layer 39 was equal to or more than 2 mm.

Figure 10:
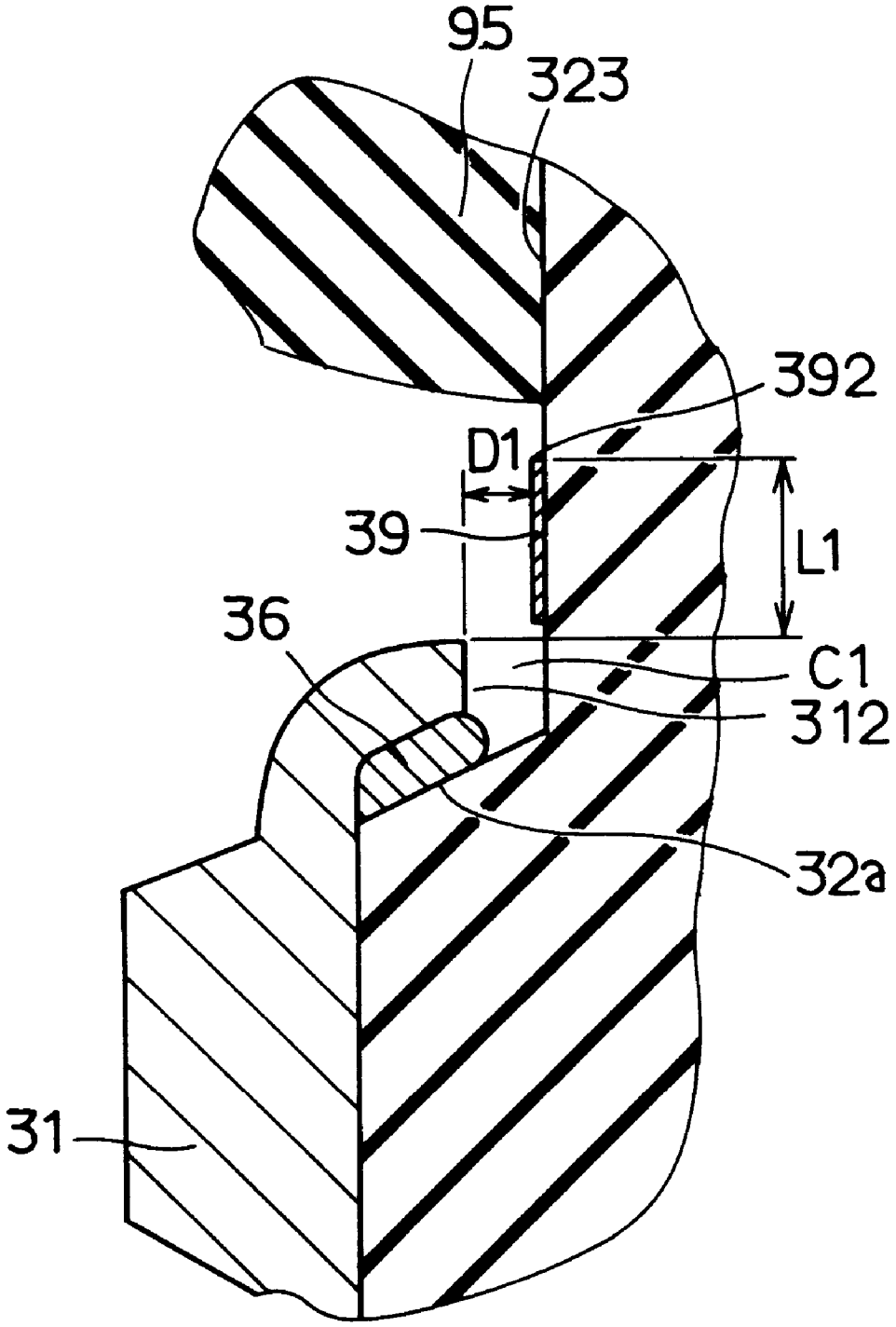
FIG. 10 is a partially enlarged cross-sectional view showing a conductive layer of a spark plug in a modified embodiment of the third embodiment.

In the third embodiment, as mentioned above, the conductive layer 39 is formed to extend from the small-diameter portion 323 to the lower side with respect to the ramp portion 32*a* in FIG. 8. However, the conductive layer 39 may be formed only with the extending part 39*a* shown in FIG. 8. In this case, it is not always necessary that the end of the extending part 39*a* corresponds to the tip of the end portion 312 of the metallic body 31, and it may be shifted in the opposite direction of the ramp portion 32*a* as shown in FIG. 10. In the present invention, this structural relationship of the conductive layer 39 (protection layer) relative to the metallic body 31 shown in FIG. 10 is regarded such that the conductive layer 39 substantially faces the metallic body 31.

Fourth Embodiment

Figure 11:
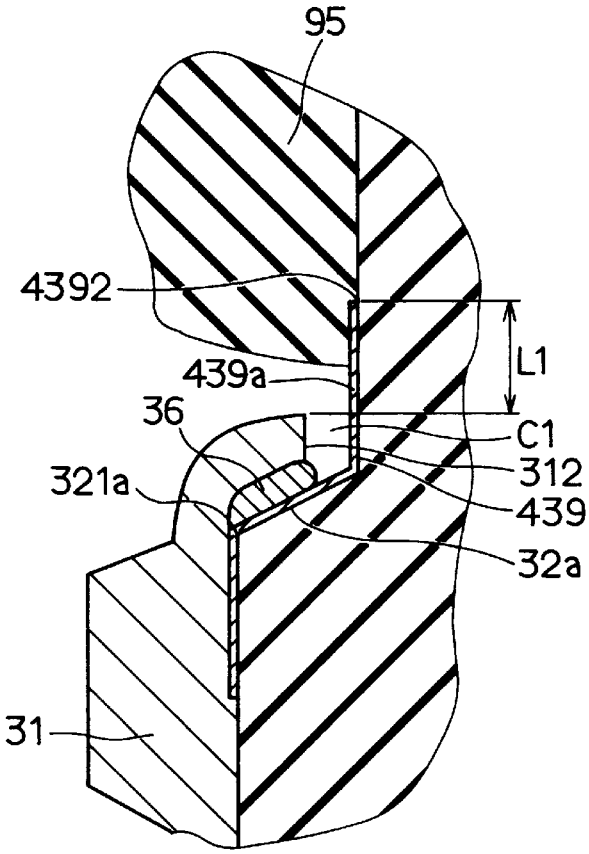
FIG. 11 is a partially enlarged cross-sectional view showing a conductive layer of a spark plug in a fourth preferred embodiment according to the present invention.

In a fourth preferred embodiment, as shown in FIG. 11, an end portion 4392 of an extending part 439*a* of a conductive layer 439 is covered with the insulating cap 95. The conductive layer 439 is made of Ag, the resistance of which is very small, and is formed by means of a baking method, a plating method, or the like.

In this embodiment, the same experiment as in the third embodiment was performed. In every case where the conductive layers 439 respectively had extending parts 439*a* with lengths L1 of 0, 1, 2, 3, 5, and 7 mm, no spike-like noise occurred. Here, the contacting length in the axial direction of the conductive layer 394 with respect to the insulating cap 95 was 0.5 mm. To obtain the conductive layer 439 having the extending part 439*a* with the length L1 of substantially 0 mm, the tip portion of the insulating cap 95 was thinned to be inserted into the space between the conductive layer 439 and the end portion 312 of the metallic body 31 with force to cover the end portion 4393 of the conductive layer 439. In a case where the insulating cap 95 having a tip portion which is not thinned is employed, the insulating cap 95 covers the insulator 32 only until the tip portion thereof abuts the end portion 312 of the metallic body 31. Therefore, in order to securely cover the end portion 4392 of the conductive layer 439 with the insulating cap 95, it is desired that the conductive layer 439 has the extending part 439*a* thereof with the length L1 equal to or more than 2 mm.

Fifth Embodiment

Figure 12:
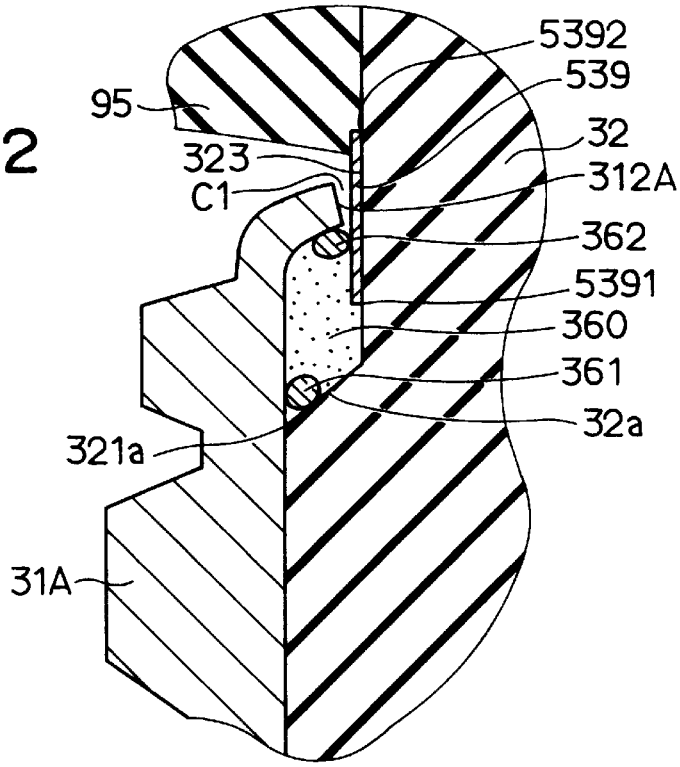
FIG. 12 is a partially enlarged cross-sectional view showing a conductive layer of a spark plug in a fifth preferred embodiment according to the present invention.

In a fifth preferred embodiment, as shown in FIG. 12, a metallic body 31A is employed in place of the metallic body 31 in the above-mentioned embodiments. Further, a space between the end portion 312A of the metallic body 31A and the insulator 32 is filled with talc powder (ceramic material), thereby forming a filling portion 360 having a cylindrical shape to encircle the insulator 32. First and second packings 361 and 362 made of metal are disposed at both ends of the filling portion 360 in the axial direction of the insulator 32 to encircle the insulator 32. In addition, a conductive layer 539 is employed in place of the conductive layer 39 in the third embodiment, and is formed on the small diameter portion 323 of the insulator 32 to face the end portion 312A of the metallic body 31A and the vicinity thereof. An end portion 5390 of the conductive layer 539 close to the ramp portion 32*a* is covered with the filling portion 360 along the entire circumference thereof and electrically communicates with the metallic body 31A through the second packing 362. The other end portion 5392 of the conductive layer 539 is covered with the insulating cap 95. As a result, the same effects as in the fourth embodiment can be obtained.

In the first embodiment, although the filling layer 37 shown in FIGS. 3 and 4 is made of silicone resin, it may be made of material selected from fluororesin, epoxy resin, insulating fat and oil material (for example, silicone oil, fluorine-contained oil, turbine oil, rustproof oil, lubricating oil, diphenyl chloride system oil or sulfonic system oil) or the like in addition to the silicone resin. In the second embodiment, although the filling layer 370 shown in FIG. 7 is made of Ag, Au, Cu or the like, the filling layer 370 may be made of another conductive material, provided that the conductive material has a resistance of $10^5$ Ω–$10^{10}$ Ω per square inch in the case where the thickness thereof is 20 μm. Accordingly, even if the corona discharge accidentally occurs, the positive charge generated by the corona discharge can be prevented from suddenly moving toward the metallic body 31 due to the resistance of the filling layer 370.

In the above-mentioned embodiments, the end portion 312, 312A of the metallic body 31, 31A has squarish corners. However, the corners of the end portion 312, 312A may be rounded, so that intensity of the electric field generated around the corners of the end portion 312, 312A can be reduced. In the third and fourth embodiments, the conductive layers 39 and 439, and the metallic body 31 electrically communicate with each other through the packing 36. Therefore, it is not usually necessary that the conductive layer has the part extending from the shoulder portion 321*a* to have the length L2. In the fifth embodiment, the conductive layer 539 can electrically communicate with the metallic body 31A through the first packing 361 in addition to through the second packing 362. However, the conductive layer 539 can further extend to contact to the first packing 361.

Sixth Embodiment

Figure 13:
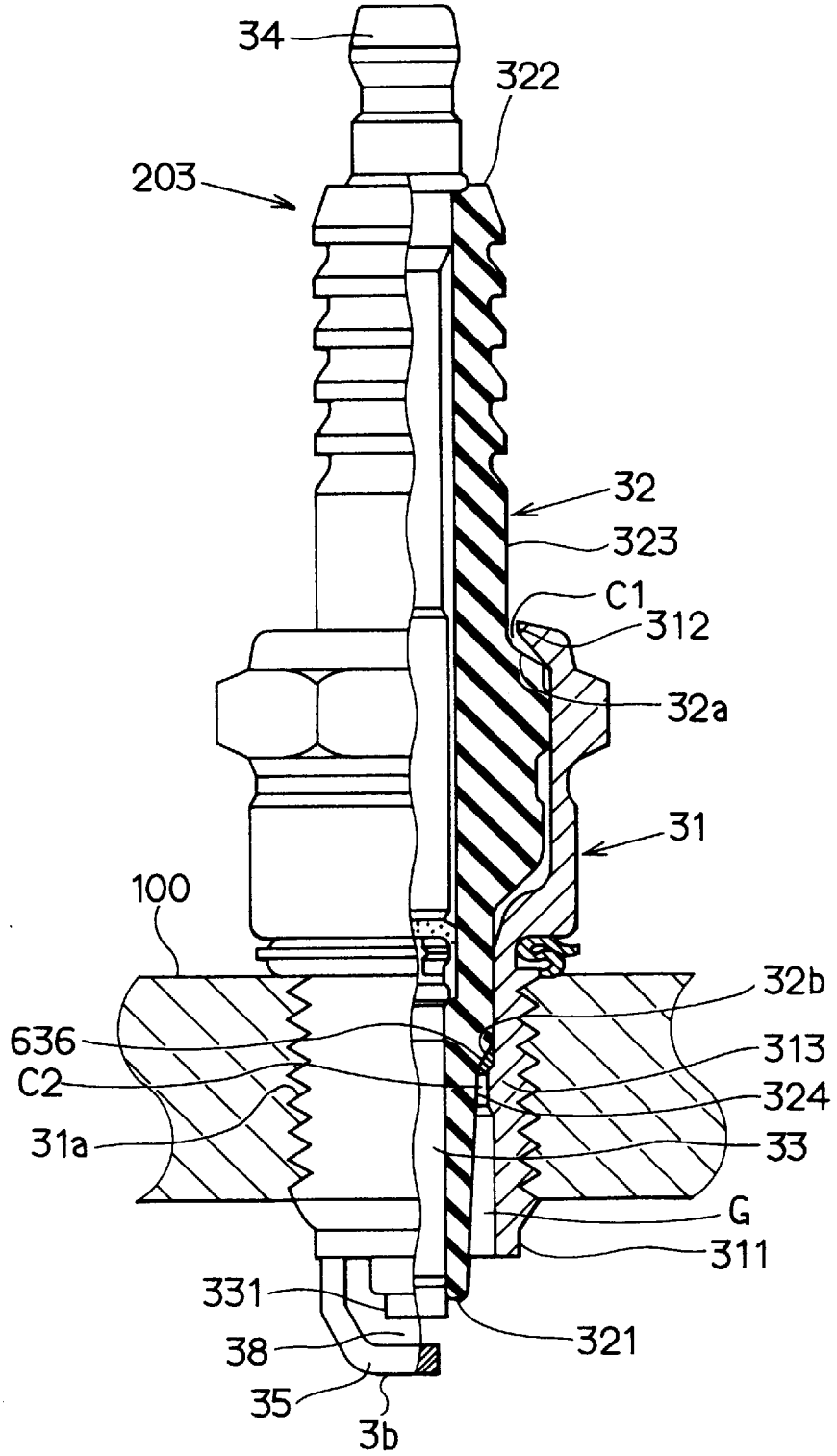
FIG. 13 is a partial cross-sectional view showing a spark plug in a sixth preferred embodiment according to the present invention.
Figure 14:
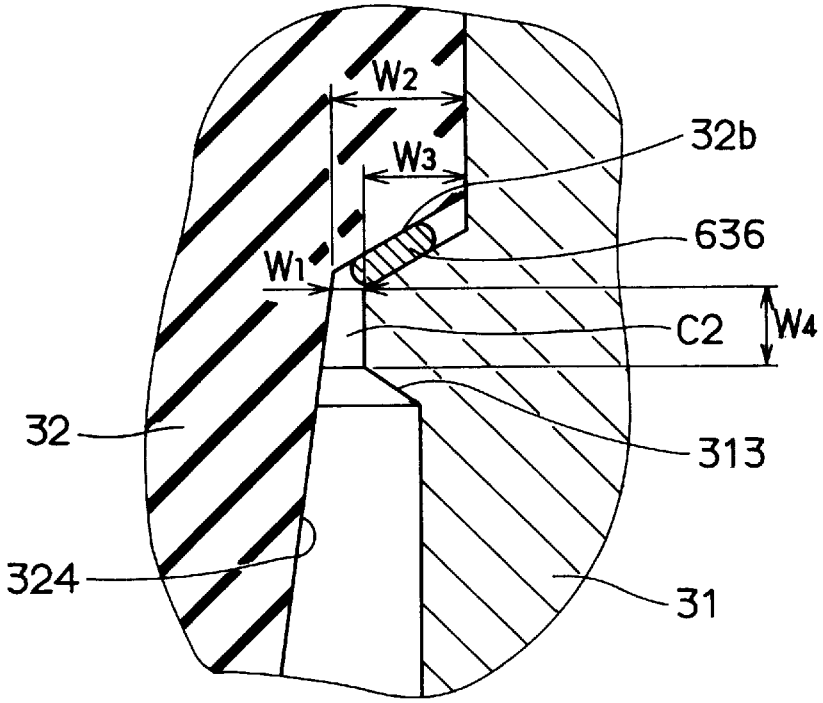
FIG. 14 is a partially enlarged cross-sectional view showing the spark plug in the sixth embodiment.

A spark plug 203 in a sixth preferred embodiment is shown in FIG. 13. The parts and components similar to those in the foregoing embodiments are shown by the same reference numerals and description thereof will be omitted. The insulator 32 of the spark plug 203 has a small diameter portion 324 extending from the ramp portion 32*b* to the end portion 321 of the insulator 32 (in the lower direction in FIG. 13). The small diameter portion 234 has a diameter which continuously decreases toward the end portion 321 of the insulator 32. Accordingly, a gas volume G of the spark plug 203 is increased and heat resistivity of the spark plug 203 is improved. Further, a sufficient length between the end portion 321 of the insulator 32 and the end portion 311 of the metallic body 31 is secured to prevent a discharge therebetween. The ramp portion 32*b* of the insulator 32 is supported by the supporting portion 313 of the metallic body 31 via a packing 636 as shown in FIGS. 13 and 14. The packing 636 is made of material having high heat resistance such as iron, copper or the like. The heat-resistant temperature of the packing 636 is very high and is more than the temperature (300° C., for example) of the air-fuel mixture in the operated state of the engine.

In the sixth embodiment, for example, the external diameter of the small diameter portion 324 adjacent to the ramp portion 32*b* is 6.9 mm and a width W2 (see FIG. 14) of the ramp portion 32*b* in the radial direction of the insulator 32 is 1.1 mm. The narrowest width W1 (see FIG. 14) of the clearance C2 between the supporting portion 313 of the metallic body 31 and the small diameter portion 324 of the insulator 32, in the radial direction of the insulator 32 is, for example, 0.7 mm. The overlapped width W3 (see FIG. 14) of the supporting portion 313 of the metallic body 31 and the ramp portion 32*b* of the insulator 32, in the radial direction of the insulator 32 is, for example, 0.4 mm. The width W4 (see FIG. 14) of the supporting portion 313 in the axial direction of the insulator 32 is, for example, 2.0 mm. Here, the cross-sectional shape of the supporting portion 313 is generally a trapezoid. It is desirable that the width W4 of the supporting portion 313 be equal to or more than 1.5 mm in order to securely support the insulator 32. Further, in the case where the overlapped width W3 of the supporting portion 313 of the metallic body 31 and the ramp portion 32*b* of the insulator 32 is smaller than three tenths of the width W2 of the supporting portion 313 of the metallic body 31, it is difficult for the supporting portion 313 to securely support the ramp portion 32*b* of the insulator 32. Therefore, it is desirable that the overlapped width W3 of the supporting portion 313 and the ramp portion 32*b* be larger than three tenths of the width W2 of the supporting portion 313.

Hereinbelow, the relationship between the width W1 and the rate of occurrence of spike-like noise generated on the waveform of voltage detected by the ion current detecting apparatus will be described referring to FIG. 15. As mentioned above, the width W1 shown in FIG. 14 is the width of the clearance C2 between the supporting portion 313 of the metallic body 31 and the small diameter portion 324 of the insulator 32 in the radial direction thereof. The relationship shown in FIG. 15 was obtained from the results of the following experiment.

First, the spark plugs 203 respectively having the widths W1 of the clearance C2 of 0.1 mm, 0.2 mm, 0.3 mm, 0.4 mm, 0.5 mm, 0.6 mm, 0.7 mm, and 0.9 mm were prepared as samples for the experiment. The spark plugs 203 had the same width W2 of the ramp portion 32*b* in the radial direction of the insulator 32 being 1.0 mm. Those spark plugs 203 were respectively installed in a combustion chamber in an internal combustion engine having a displacement of 1800 cc and four cylinders. In a full-open state of a throttle valve (at an engine speed of 750 rpm), the voltage generated in the resistor 7 in the ion current detecting apparatus was detected for 500 cycles.

Figure 15:
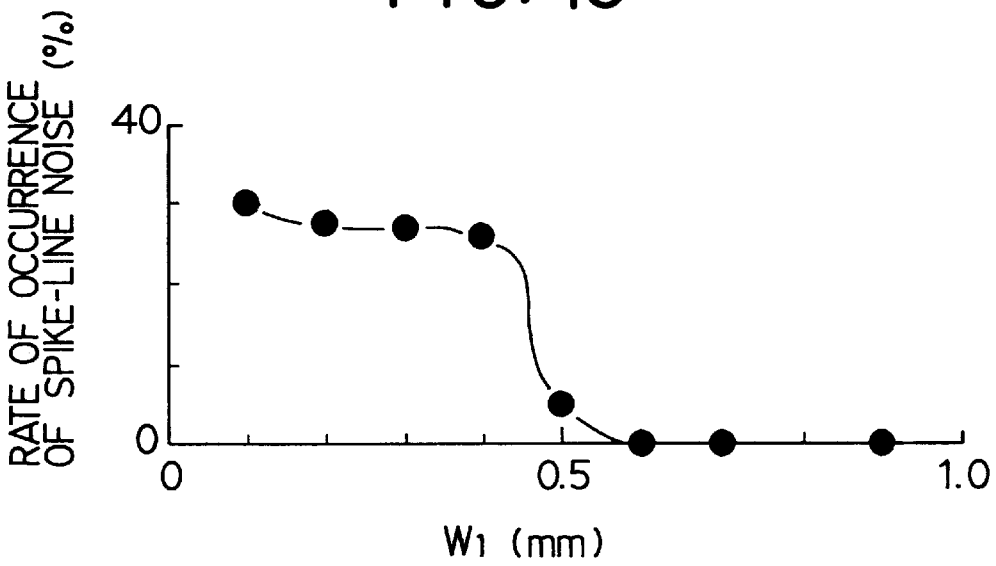
FIG. 15 is a graph showing a relationship between a rate of occurrence of spike-like noise and a width W1 of a clearance between a ramp portion of an insulator and a protruding portion of a metallic body in the spark plug in the sixth embodiment.

According to the results of the above-mentioned experiment, as shown in FIG. 15, in the case where the width W1 of the clearance C2 was no more than 0.4 mm, the rate of occurrence of the spike-like noise was approximately 20% to 30%. As opposed to this, in the case where the width W1 of the clearance C2 was no less than 0.5 mm, the rate of occurrence of the spike-like noise was no more than 5%. Accordingly, it was confirmed that the rate of occurrence of the spike-like noise can be greatly reduced when the width W1 of the clearance C2 is no less than 0.5 mm. Further, in the case where the width W1 of the clearance C2 was no less than 0.6 mm, the rate of occurrence of the spike-like noise was substantially zero and the occurrence of the spike-like noise could be completely prevented.

The reason why the above-mentioned effect can be obtained is explained in the following way. The clearance C2 between the supporting portion 313 of the metallic body 31 and the ramp portion 32*b* of the insulator 32 in the radial direction thereof is conventionally provided. One of the reasons the clearance C2 is provided is because it is necessary that the overlapped width W3 of the supporting portion 313 and the ramp portion 32*b* in the radial direction of the insulator 32 is secured as long as possible so that the insulator 32 is securely supported by the supporting portion 313 of the metallic body 31. Another reason is because when the insulator 32 is inserted into the metallic body 31, the clearance C2 prevents the interference between the ramp portion 32*b* and the supporting portion 313 so that the insulator 32 is smoothly inserted into the metallic body 31.

On the other hand, a high voltage of several tens of kilovolts is applied to the metallic body 31 and the center electrode 33, thereby generating electric field having a large intensity in the clearance C2 between the metallic body 31 and the center electrode 33. The clearance C2 is filled with air having a small dielectric constant and a small dielectric strength compared to the insulator 32. Therefore, if the width W1 of the clearance C2 is too small, dielectric breakdown easily occurs in the clearance C2 to cause the corona discharge therein, thereby resulting in the spike-like noise. In the sixth embodiment, however, the width W1 of the clearance C2 in the radial direction of the insulator 32 is larger than the specific length. Therefore, the increase of the intensity of the electric field produced in the clearance C2 is suppressed, so that the occurrence of the spike-like noise is prevented.

In the sixth embodiment, it is possible that the clearance C2 between the ramp portion 32*b* of the insulator 32 and the supporting portion 313 of the metallic body 31 is filled with the packing 636 made of iron, copper, or the like so that the corona discharge does not occur. In this case, however, the distance between the packing 636 having electrical conductivity and the discharge gap 38 becomes small, so that the packing 636 is liable to be shunted due to the spark discharge generated around the discharge gap 38. As opposed to this, in the spark plug 203 in the sixth embodiment, the packing 636 is not shunted due to the spark discharge.

In the sixth embodiment, although the supporting portion 313 has a general trapezoid cross-section, it may have a generally triangular cross-section. Accordingly, the width W1 of the clearance C2 in the radial direction of the insulator 32 is increased, so that the concentration of the electric field in the clearance C2 is suppressed. Further, the corners of the supporting portion 313 of the metallic body may be rounded so that the concentration of the electric field around the supporting portion 313 is mitigated. In the spark plug 203 shown in FIGS. 13 and 14, although the insulator 32 does not have the above-mentioned conductive layer, it is apparent that the insulator 32 can have the conductive layer thereon to face the supporting portion 313 of the metallic body 31 to assure the above mentioned dimensions.

Seventh Embodiment

A spark plug 303 in a seventh preferred embodiment is shown in FIG. 19. The parts and components similar to those in the above-mentioned embodiments are shown by the same reference numerals and description thereof will be omitted. In the spark plug 303, the metallic body 31 is fixed to the insulator 32 through the packings 36 and 636 which are respectively provided on the ramp portions 32*a* and 32*b* of the insulator 32. First, the packing 636 is disposed on the ramp portion 32*b* of the insulator 32, and then the insulator 32 is inserted into the metallic body 31. Then, the packing 36 is disposed on the ramp portion 32*a* of the insulator 32. In this state, the end portion 312 of the metallic body 31 and the vicinity thereof is caulked bending inwardly, so that the packing 63 and 636 are pressed between the ramp portions 32*a* and a supporting portion 314 and between the ramp portion 32*b* and the supporting portion 313 to closely contact the ramp portions 32*a* and 32*b* and the supporting portions 314 and 313.

Figure 16:
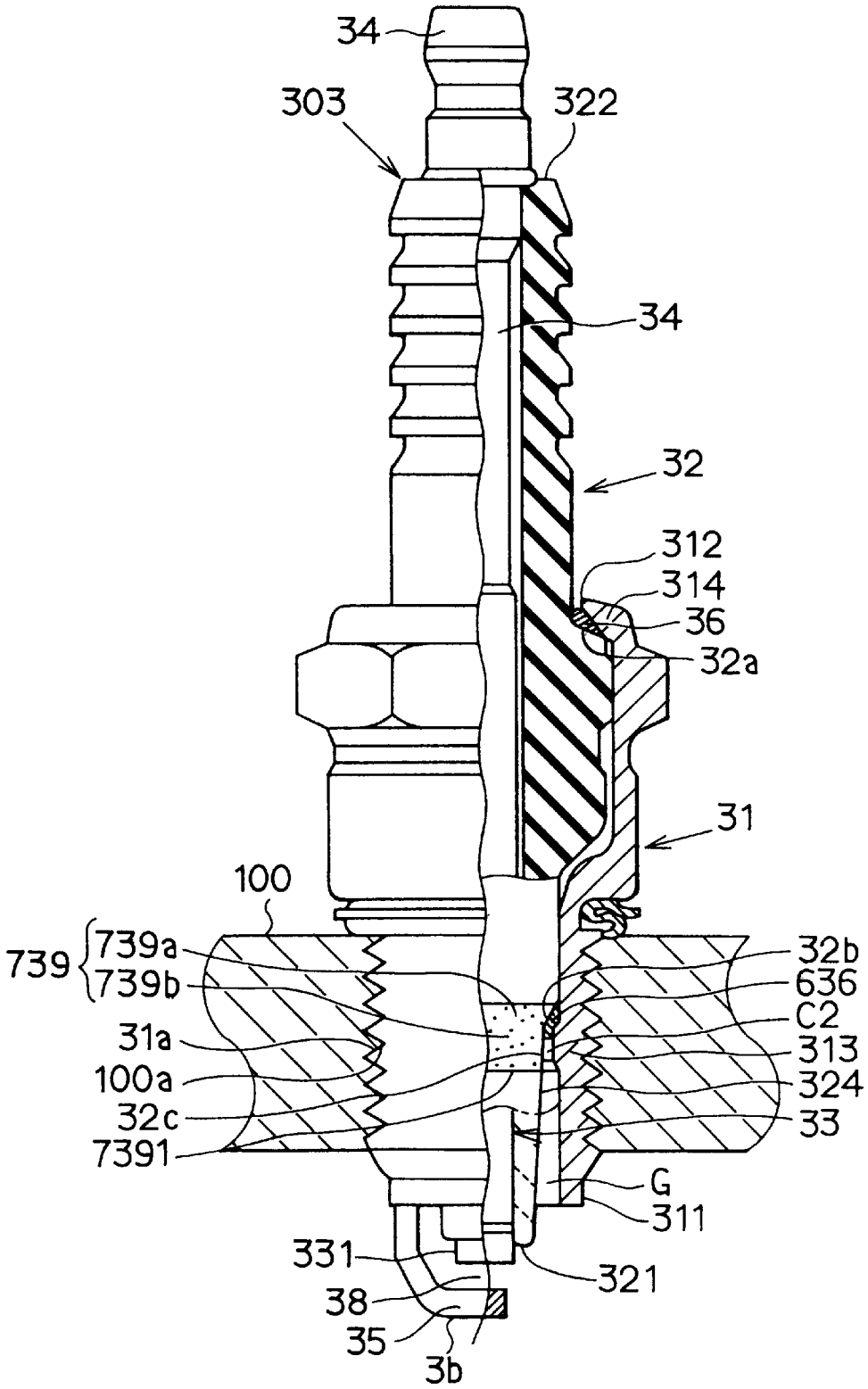
FIG. 16 is a partial cross-sectional view showing a spark plug in a seventh preferred embodiment according to the present invention.

The insulator 32 has a band-like conductive layer 739 encircling a portion thereof on a specific portion to face the supporting portion 313 of the metallic body 31 and the vicinity thereof. The specific portion of the insulator 32 includes the ramp portion 32*b* and an extending portion 32*c* shown in FIG. 17 which is a part of the small diameter portion 324. As shown in FIGS. 16 and 17, the conductive layer 739 includes a first band-like portion 739*a* formed on the ramp portion 32*b* and a second band-like portion 739*b* formed on the extending portion 32*c* to extend from the ramp portion 32*b* toward the end portion 321 of the insulator 32 by a specific length in the axial direction thereof. The first band-like portion 739*a* of the conductive layer 739 is electrically connected to the metallic body 31 through the packing 636 on the entire circumference thereof.

The conductive layer 739 is made of $RuO_2$ having a resistance of approximately $10^8$ Ω per square inch in the case where the thickness thereof is approximately 20 μm. In the case where the thickness of the conductive layer 739 is too thin, the effect of dispersing the positive charge accumulated on the insulator 32 (described later) is reduced. On the other hand, in the case where the thickness of the conductive layer 739 is too thick, the manufacturing performance thereof is deteriorated. Therefore, it is desired that the thickness be in a range of 10 μm–60 μm. To form the conductive layer 739 on the insulator 32, first, a paste including the $RuO_2$ is coated on the specific portion of the insulator 32, and is burned within a furnace at a high temperature (800° C., for example) for a specific time (20 minutes, for example). The conductive layer 739 can be made of material having a pyrochlore-type crystal structure such as $Bi_2Ru_2O_7$ and the like in addition to $RuO_2$.

When a high voltage is applied to the spark plug 303, a corona discharge is likely to occur around the supporting portion 313 of the metallic body 31. As mentioned in the foregoing embodiments, a positive charge is produced in response to the corona discharge, and is drawn toward the outer surface of the insulator 32 to be locally accumulated thereon. The thus locally accumulated positive charge suddenly flows into the metallic body 31 in response to an external factor of some kind, thereby resulting in the spike-like noise on the waveform of the voltage detected by the ion current detecting apparatus. However, in the seventh embodiment, because the band-like conductive layer 739 is formed on the insulator 32 to encircle the specific portion of the insulator 32 around the supporting portion 313 of the metallic body 31, the positive charge drawn to the insulator 32 is dispersed toward the entire surface of the conductive layer 739, so that the positive charge is prevented from locally accumulating on the insulator 32. As a result, the positive charge is prevented from suddenly flowing into the metallic body 31, so that the occurrence of the spike-like noise can be suppressed.

Further, whenever the spark is discharged in the discharge gap 38, the discharge voltage across the center electrode 33 and the ground electrode 35 (that is, the metallic body 31) drops to be generally zero. At that time, a part of the accumulated positive charge is recombined with ions produced by the burning of the air-fuel mixture. In the seventh embodiment, because the positive charge is dispersed to the entire surface of the conductive layer 739, the dispersed positive charge can be efficiently recombined with the ions in the air-fuel mixture, so that the amount of the accumulated positive charge is decreased. As a result, the positive charge is further prevented from accumulating on the surface of the insulator 32.

In the case where the resistance of the conductive layer 739 is very small (approximately zero), the electric field is likely to be concentrated around the end portion 7391 shown in FIG. 16 of the conductive layer 739, because the end portion 7391 is exposed to the air-fuel mixture. The concentration of the electric field causes the corona discharge. However, in this embodiment, the conductive layer 739 has a resistance of approximately $10^8$ Ω per square inch in the case where the thickness thereof is approximately 20 μm. Accordingly, the concentration of the electric field around the end portion 7391 of the conductive layer 739 can be mitigated to prevent the occurrence of the corona discharge. It is desired that the resistance of the conductive layer 739 be more than $10^5$ Ω per square inch in the same thickness condition as mentioned above. On the other hand, in the case where the resistance of the conductive layer 739 is more than $10^{10}$ Ω per square inch in the case where the thickness thereof is 20 μm, the conductive layer 739 cannot effectively disperse the positive charge. More preferably, it is desired that the resistance of the conductive layer 739 with a thickness of 20 μm be in a range of $10^6$ Ω to $10^9$ Ω per square inch.

In the seventh embodiment, the conductive layer 739 is electrically connected to the metallic body 31 through the packing 636. Accordingly, in the operated state of the spark plug 303, the positive charge dispersed on the entire surface of the conductive layer 739 flows into the metallic body 31 little by little. As a result, the local concentration of the positive charge on the insulator 32 can be further suppressed. However, it is not always necessary that the conductive layer 739 and the metallic body 31 electrically communicate with each other, and as shown in FIG. 18, the conductive layer 739 may be formed to not electrically communicate with the metallic body 31.

Eighth Embodiment

In an eighth preferred embodiment, the insulator 32 has a band-like conductive layer 839 shown in FIG. 19 in place of the band-like conductive layer 739 in the seventh embodiment. The conductive layer 839 includes a first band-like portion 839*a* formed on the ramp portion 32*b* and a second band-like portion 839*b* formed on the extending portion 32*c* to extend from the ramp portion 32*b* toward the end portion 321 of the insulator 32 by a specific length in the axial direction thereof. The conductive layer 839 is made of a mixture of conductive material and a glass-system insulating material such as borosilicate glass, borosilicate lead glass, or the like. The other features are the same as those in the seventh embodiment.

The conductive layer 839 is formed in the following way. First, a paste containing the conductive material is coated on the ramp portion 32*b* of the insulator 32 and on the extending portion 32*c* thereof to encircle the insulator 32, thereby forming a first paste layer 839*a* shown in FIG. 20. A paste containing the glass-system insulating material is further coated on the first paste layer 839*a* to cover at least the portion corresponding to ramp portion 32*b* and the extending portion 32*c* of the insulator 32, thereby forming a second paste layer 839*b*. Thereafter, the paste layers 839*a* and 839*b* are burned in a furnace at a high temperature (800° C., for example) for a specific time (20 minutes, for example), whereby the conductive layer 839 shown in FIG. 19 made of the mixture of the conductive material and the glass-system insulating material is obtained. Here, the end portion 8391*a* of the first paste layer 8391 on an opposite side of the ramp portion 32*b* is covered with the second paste layer 8392 and is burned. Therefore, the end portion 8391 of the conductive layer 839 which is exposed to the air-fuel mixture has a large resistance compared to the other portion of the conductive layer 839, because the mixing ratio of the conductive material with respect to the glass-system insulating material in the end portion 8391*a* of the conductive layer 839 is smaller than that of the other portion thereof. Therefore, the concentration of the electrical field around the end portion 8391 of the conductive layer 839 can be suppressed. In addition, the glass-system insulating material protects the conductive material in the conductive layer 839 from various external factors. The other effects of the conductive layer 839 are the same as those of the conductive layer 739 in the seventh embodiment.

In the seventh and eighth embodiments, although the conductive layers 739 and 839 are formed on the insulator 32 to encircle the specific portion of the insulator 32, they may be partly cut. Further, although the metallic body 31 is fixed to the insulator 32 through the packings 36 and 636, the packings 36 and 636 are not always necessary. The second band-like portions of the conductive layers 739 and 839 formed on the extending portion 32*c* can be lengthened toward the end portion 321 shown in FIG. 16 of the insulator 32. Although the supporting portion 313 has a general trapezoid cross-section, it may have a generally triangular cross-section. Accordingly, the width of the clearance C2 in the radial direction is increased, so that the concentration of electric field in the clearance C2 is suppressed. Further, the corners of the supporting portion 313 of the metallic body may be rounded so that the concentration of the electric field around the supporting portion 313 is suppressed.

Ninth Embodiment

Figure 21:
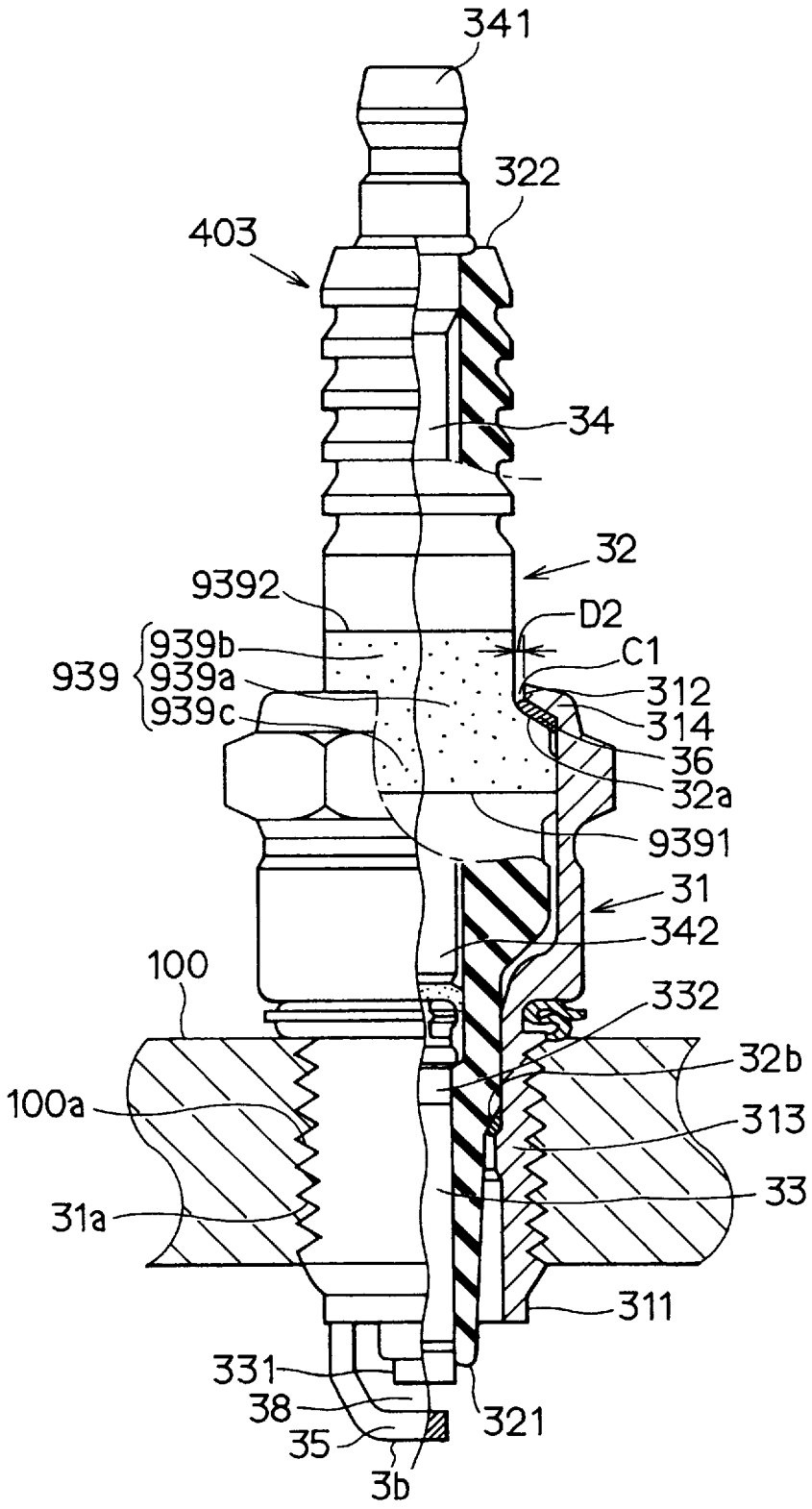
FIG. 21 is a partial cross-sectional view showing a spark plug in a ninth preferred embodiment according to the present invention.
Figure 22A:
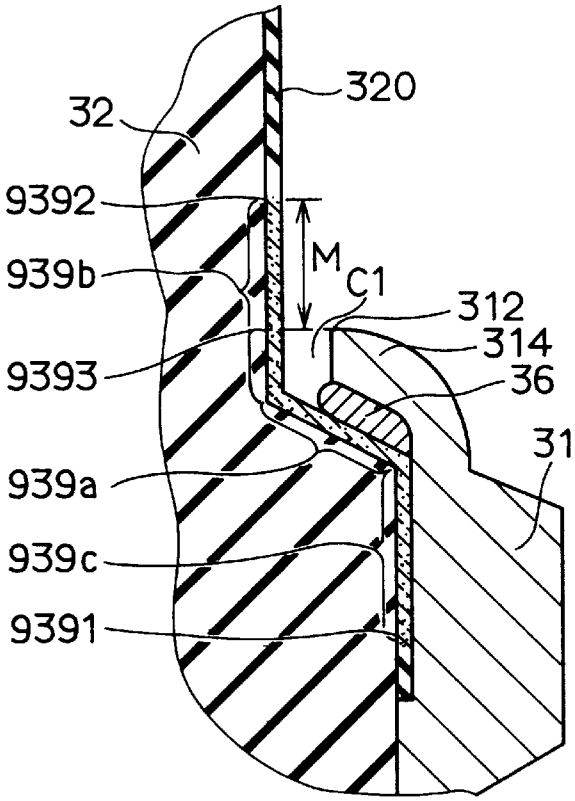
FIGS. 22A and 22B are partially enlarged cross-sectional views for explaining a process for forming a conductive layer of the spark plug in the ninth embodiment.
Figure 22B:
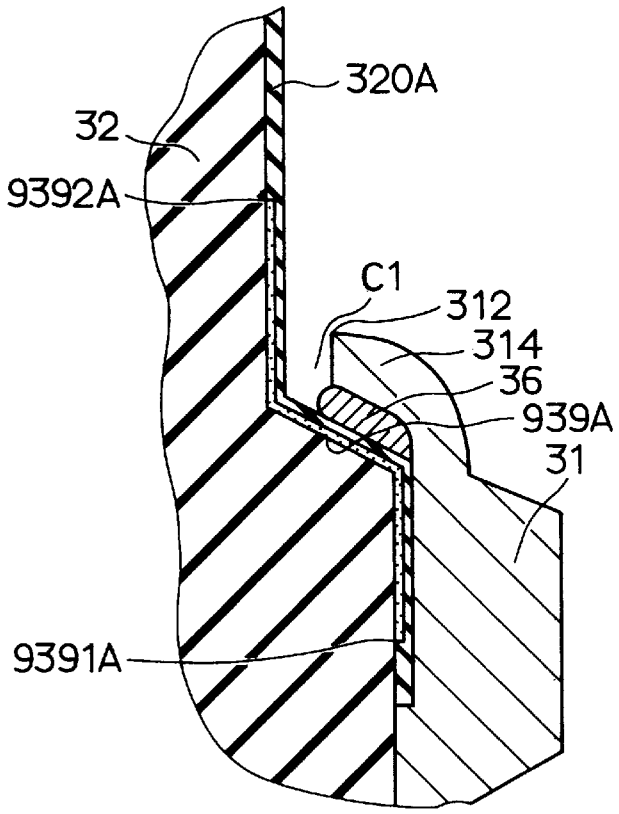

A spark plug 403 in a ninth preferred embodiment is shown in FIG. 21. The parts and components similar to those in the above-mentioned embodiments are shown by the same reference numerals and description thereof will be omitted. As shown in FIG. 21, a band-like conductive layer 939 is formed on the circumferential surface of the insulator 32 to encircle a specific portion of the insulator 32 adjacent to the supporting portion 314 of the metallic body 31. As shown in FIGS. 22A and 22B, the conductive layer 939 has a first band-like portion 939*a* formed on the ramp portion 32*a* of the insulator 32, a second band-like portion 939*b* extending from the ramp portion 32*a* toward the end portion 322 of the insulator 32 (in the upper direction in FIG. 21) by a specific length (6 mm, for example), and a third band-like portion 939*c* extending from the ramp portion 32*a* toward the other end portion 321 (in the lower direction in FIG. 21) by a specific length (0.5 mm, for example). The conductive layer 939 includes conductive material and a glass-system insulating material. Further, a glass-system insulating layer 320 is formed on the insulator 32 on the side of the end portion 322 with respect to the ramp portion 32*a* except the portion on which the conductive layer 939 is formed.

In the second band-like portion 939*b* of the conductive layer 939, as shown in FIG. 22A, a length M in the axial direction of the insulator 32 between an end portion 9392 and a portion 9393 thereof corresponding to the tip portion of the end portion 312 of the metallic body 31 is, for example, approximately 5 mm. The width D2 of the clearance C1 between the end portion 312 and the conductive layer 939 in the radial direction of the insulator is, for example, approximately 0.4 mm. The conductive layer 939 is electrically connected to the metallic body 31 at the first band-like portion 939*a* through the packing 36, and directly at the third band-like portion 939*c*.

The conductive layer 939 is made of $RuO_2$ having a resistance of approximately $10^8$ Ω per square inch in the case where the thickness thereof is approximately 20 μm. In the case where the thickness of the conductive layer 939 is too thin, the effect of preventing the spike-like noise is reduced. To the contrary, in the case where the thickness of the conductive layer 939 is too thick, the manufacturing performance thereof is deteriorated. Therefore, the thickness is desired to be in a range of 10 μm–60 μm.

Next, a method of forming the conductive layer 939 and the glass-system insulating layer 320 will be explained referring to FIGS. 22A and 22B. First, for example, $RuO_2$ powder of 20 wt %, borosilicate lead glass of 50 wt %, and binder material and a solvent of 30 wt % are mixed, thereby forming a conductive paste. The thus-formed conductive paste is coated on the specific portion of the insulator 32 on which the conductive layer 939 is to be formed, thereby forming a conductive paste layer 939A shown in FIG. 22B. Thereafter, for example, $SiO_2$ (glass-system insulating material) of 45 wt %, PbO of 30 wt %, and $B_2O_3$ of 25 wt % are mixed with a solvent, thereby forming a glass-system insulating paste. The glass-system insulating paste is coated on the insulator 32 from around the end portion 9391A of the conductive paste layer 939A to the end portion 322 of the insulator 32, thereby forming a glass-system insulating paste layer 320A shown in FIG. 22B.

Subsequently, the insulator 32 is disposed in a furnace at a high temperature (800° C., for example) for a specific time (20 minutes, for example) so that the conductive paste layer 939A and the glass-system insulating paste layer 320A coated on the insulator 32 are burned. As a result, as shown in FIG. 22A, the conductive layer 939 made of the conductive material and the glass-system insulating material and the glass-system insulating layer 320 made of the glass-system insulating material are obtained.

The above-mentioned burning process is performed on the conductive paste layer 939A having the end portions 9391A and 9392A thereof covered with the glass-system insulating paste layer 320A. Therefore, the both end portions 9391 and 9392 of the conductive layer 939 respectively include the conductive material, the mixing ratio of which is smaller than that in the other portion of the conductive layer 939, to have a resistance larger than that of the other portion of the conductive layer 939. As a result, although the end portion 9392 of the conductive layer 939 is exposed to the air-fuel mixture, the concentration of the electrical field produced around the end portion 9392 can be suppressed. Here, in the case where the thickness of the glass-system insulating paste layer 320A is too thick with respect to the thickness of the conductive paste layer 939A, it is difficult that the conductive layer 939 obtained from the paste layers 320A and 939A has sufficient conductivity. Therefore, it is desired that the thickness of the glass-system insulating paste layer 320A be two to ten times thicker than the conductive paste layer 939A.

In the operated state of the spark plug 403, the glass-system insulating material included in the conductive layer 939 protects the conductive material therein from various external factors such as an oxidization atmosphere caused by the corona discharge, heat from the engine, undesirable components in the air-fuel mixture, external impacts, and the like. Further, because the glass-system insulating layer 320 is formed not only on the conductive layer 939 but also on the insulator 32 on which the conductive layer 939 is not formed on the side of the end portion 322, the circumferential surface of the insulator 32 as well as the conductive layer 939 can be protected from the various external factors. The other effects of preventing the spike-like noise and the like are the same as those in the foregoing embodiments.

In the ninth embodiment, the length M shown in FIG. 22A is approximately 5 mm, and it is desired to be more than 2 mm so that the conductive layer 939 efficiently prevents the occurrence of the spike-like noise. The second band-like portion 939*b* of the conductive layer 939 may be formed on the entire surface of the insulator 32 on the side of the end portion 322 thereof with respect to the ramp portion 32*a* so that the positive charge can be dispersed to the entire surface of the insulator 32 on the side of the end portion 322.

Tenth Embodiment

Figure 23A:
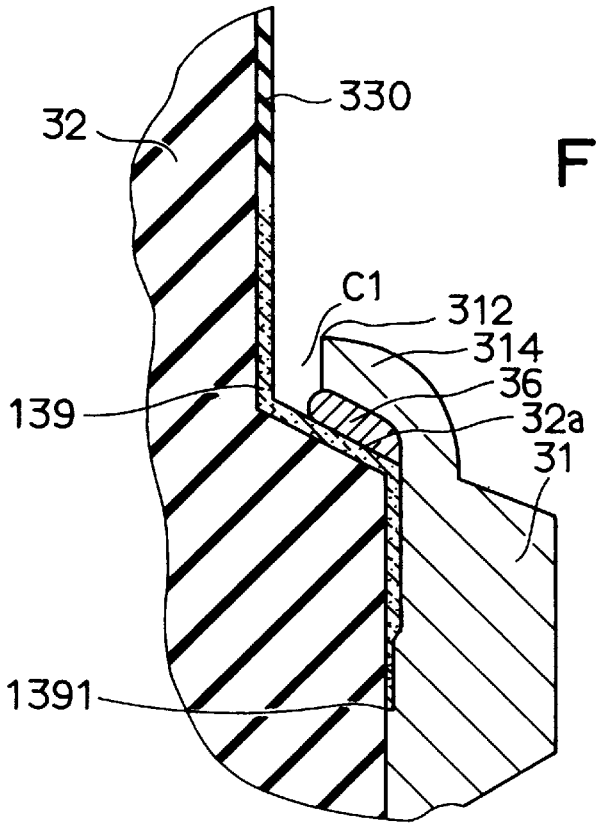
FIGS. 23A and 23B are partially enlarged cross-sectional views for explaining a process of forming a conductive layer of a spark plug in a tenth preferred embodiment according to the present invention.
Figure 23B:
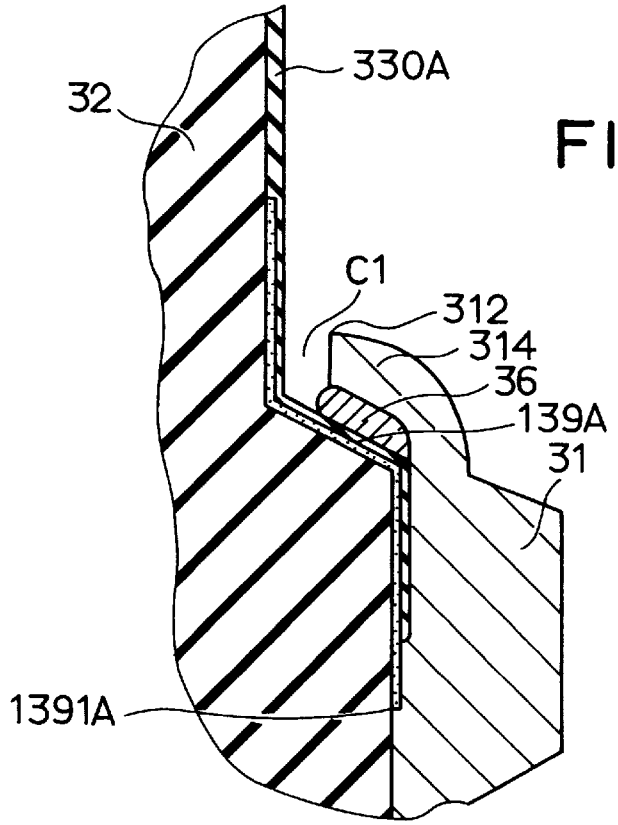

In a tenth preferred embodiment, a conductive layer 139 shown in FIG. 23A is formed on the insulator 32 in place of the conductive layer 939 in the ninth embodiment. In this embodiment, in the process of forming the conductive layer 139, as shown in FIG. 23B, after coating a conductive paste layer 139A, the above-mentioned glass-system insulating paste is coated on the insulator 32 to not cover the end portion 1391A of the conductive paste layer 139A, thereby forming a glass-system insulating paste layer 330A. The other processes for forming the conductive layer 139 are the same as in the ninth embodiment. Accordingly, the conductive layer 139 and a glass-system insulating layer 330 are formed on the insulator 32 as shown in FIG. 23A. Here, because the end portion 1391A of the conductive paste layer 139A is not covered with the glass-system insulating paste layer 330A before the burning process, the end portion 1391 of the conductive layer 139 corresponding to the end portion 1391A of the conductive paste layer 1391A are mainly composed of conductive material. The end portion 1391 of the conductive layer 139 is not exposed to air. According to the structure in the tenth embodiment, the same effects as in the foregoing embodiments can be obtained.

In the ninth and tenth embodiments, although the is conductive layers 939 and 139 respectively have the third band-like portions extending from the ramp portion 32*a* of the insulator toward the end portion 321 of the insulator, it is not always necessary to have the third band-like portions. Further, in the ninth and tenth embodiments, after the glass-system insulating paste layer and the conductive paste layer are formed, the burning process is performed. However, the burning process may be performed after a paste layer including the glass-system insulating material and the conductive material is formed. As mentioned above, the corners of the end portion 312 of the metallic body 31 can be rounded so that the concentration of electric field around the corners can be suppressed.

Eleventh Embodiment

Figure 24:
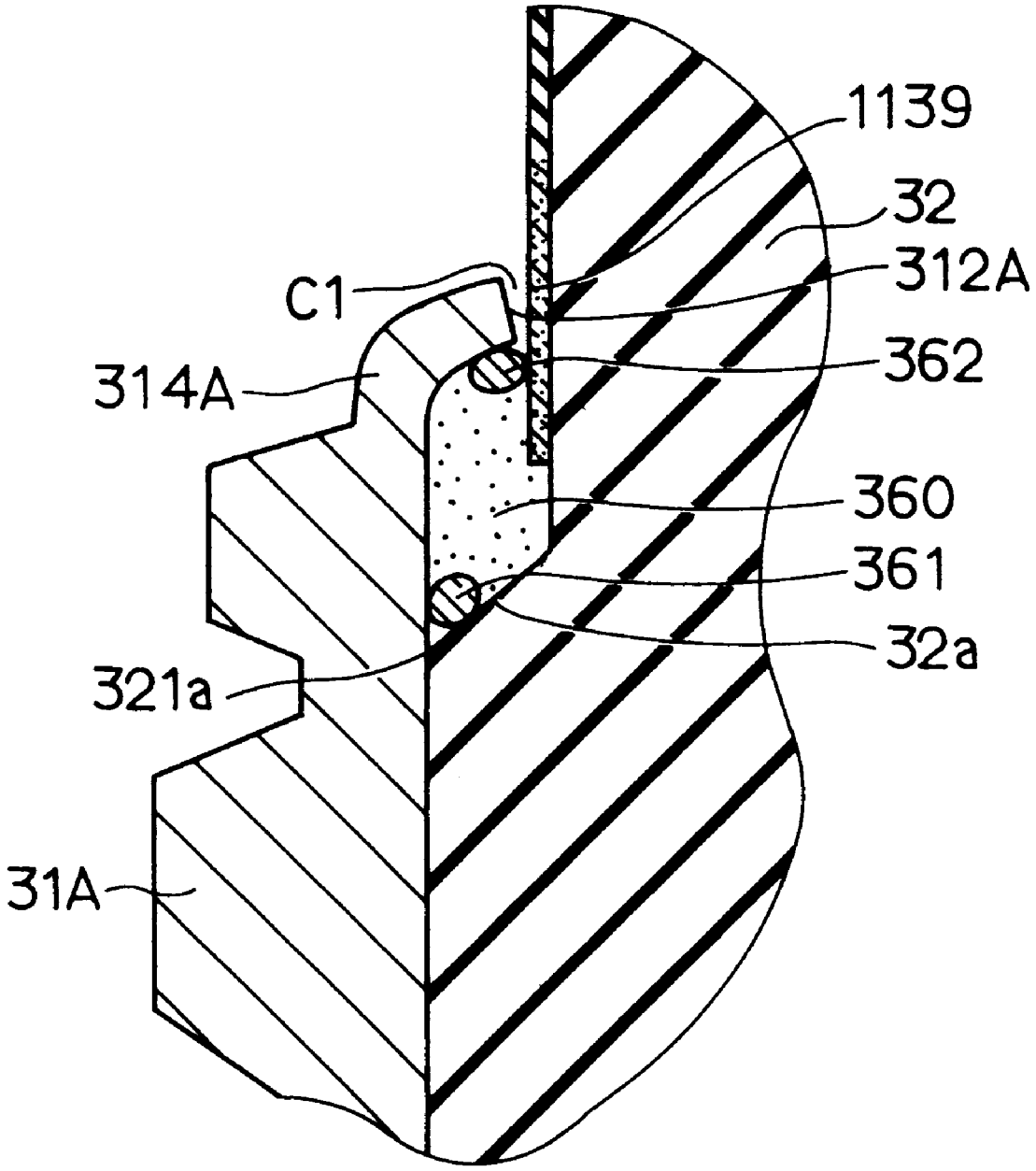
FIG. 24 is a partially enlarged cross-sectional view showing a conductive layer of a spark plug in an eleventh preferred embodiment according to the present invention.

In a eleventh preferred embodiment, a sealing structure between the ramp portion 32*a* of the insulator 32 and the end portion 312A of the metallic body 31A is modified as shown in FIG. 24, which is the same as the fifth embodiment shown in FIG. 12. In the eleventh embodiment, a conductive layer 1139 shown in FIG. 24 is formed on the insulator 32 having the above mentioned sealing structure in place of the conductive layer 939 in the ninth embodiment. The conductive layer 1139 is formed at a portion facing the supporting portion 314A of the metallic body 31A and the vicinity thereof to encircle the insulator 32, and is electrically connected to the metallic body 31A through the packing 362. The conductive layer 1139 is not formed on the ramp portion 32*a* of the insulator 32. The method of forming the insulator 1139 is the same as in the ninth embodiment. Accordingly, the same effects the foregoing embodiments can be obtained.

In the foregoing embodiments according to the present invention, it is preferable that the conductive layer includes ruthenium oxide or a material having a pyrochlore-type crystal structure of 1 wt % to 15 wt %, and a glass-system insulating material of 70 wt % to 95 wt %. It is more preferable that the conductive layer includes ruthenium oxide or the material having the pyrochlore-type crystal structure of 2 wt % to 10 wt %, and the glass-system insulating material of 75 wt % to 95 wt %. An example of the material having the pyrochlore-type crystal structure is $Bi_2Ru_2O_7$ including ruthenium (Ru). As the glass-system insulating material, borosilicate glass, borosilicate lead glass, or the like is applicable. By forming the conductive layer with the above-mentioned composition of the above-mentioned materials, the conductive layer can have the resistance in a range of $10^6$ Ω to $10^{10}$ Ω per square inch in the case where the thickness thereof is approximately 20 μm. As a result, the occurrence of the corona discharge can be effectively prevented.

Twelfth Embodiment

Figure 25:
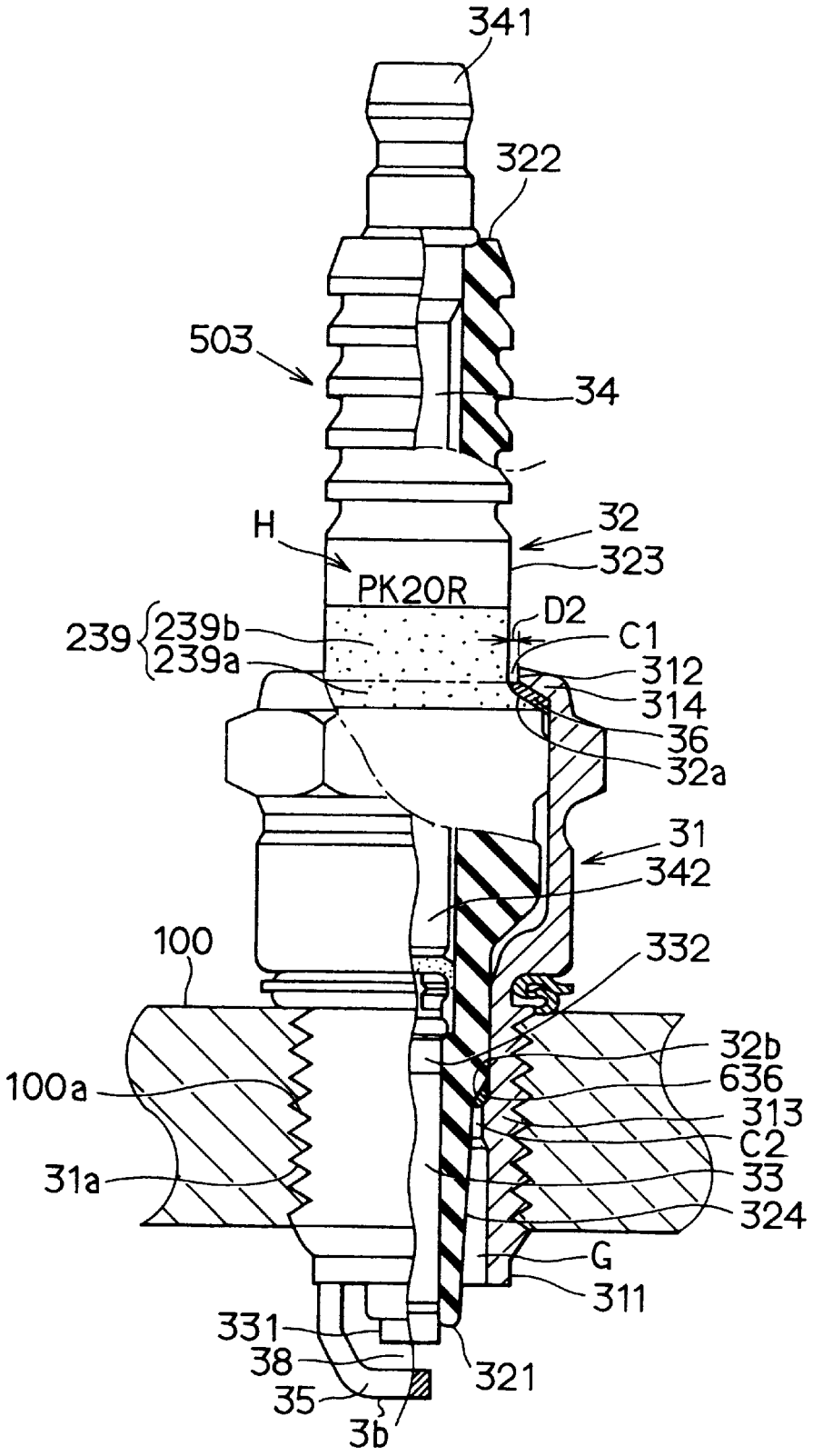
FIG. 25 is a partial cross-sectional view showing a spark plug in a twelfth preferred embodiment according to the present invention.
Figure 26:
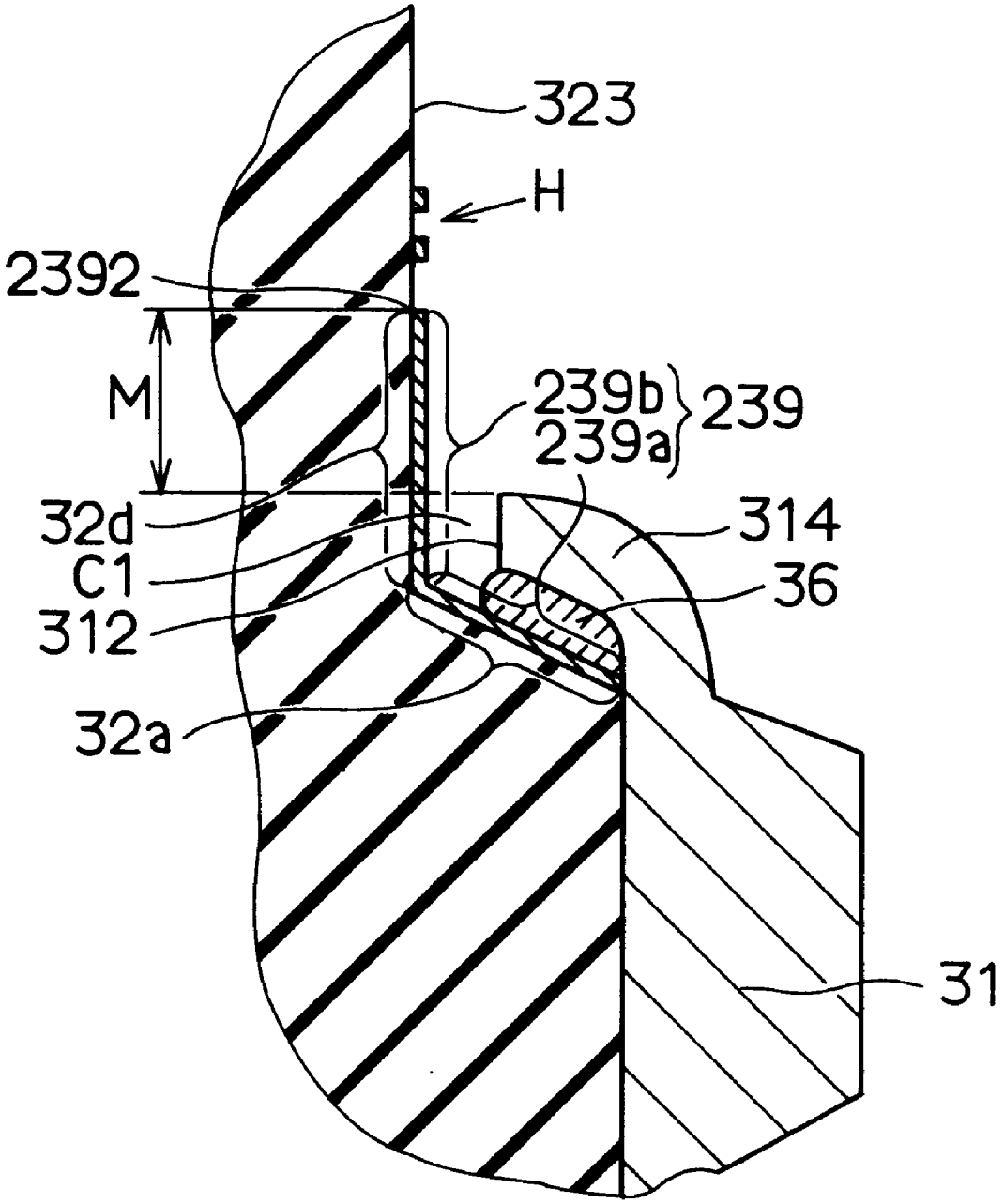
FIG. 26 is a partially enlarged cross-sectional view showing a conductive layer of the spark plug in the twelfth embodiment.

A spark plug 503 in a twelfth preferred embodiment are shown in FIG. 25. The parts and components similar to those in the foregoing embodiments are shown by the same reference numerals and will be omitted. The spark plug 503 has a conductive layer 239 in place of the conductive layer 939 in the ninth embodiment. The conductive layer 239 is formed on the insulator 32 to encircle a specific portion thereof. That is, the conductive layer 239 includes a first band-like portion 239*a* formed on the ramp portion 32*a* and a second band-like portion 239*b* formed on an extending portion 32*d* shown in FIG. 26 extending from the ramp portion 32*a* to the side of the clearance C1 (that is, on a part of the small diameter portion 323). The first band-like portion 239*a* of the conductive layer 239 is electrically connected to the metallic body 31 through the packing 36. As shown in FIG. 26, a length M between the end portion 2392 of the conductive layer 239 and a portion thereof corresponding to the tip of the end portion 312 of the metallic body 31 in the axial direction of the insulator 32 (in the vertical direction in FIG. 25), is, for example, approximately 0.5 mm. The width D1 of the clearance C1 between the end portion 312 of the metallic body 31 and the conductive layer 239 in the radial direction of the insulator 32 is, for example, approximately 0.4 mm. The conductive layer 239 is made of $RuO_2$ having a resistance of approximately $10^8$ Ω per square inch in the case where the thickness thereof is approximately 20 μm. As mentioned in the foregoing embodiments, the thickness is desired to be in a range of 10 μm–60 μm, and in the this embodiment, it is 20 μm. The effects of the conductive layer 239 are the same as those of the other conductive layers in the foregoing embodiments.

Further, in the twelfth embodiment, a product number H shown in FIGS. 25 and 26 (for example, PK20R) is formed on the insulator 32 on the side of the end portion 322 of the insulator 32 with respect to the conductive layer 239. The product number H is hereinafter called a display member H. The display member H is made of the same material as that of the conductive layer 239.

Figure 27A:
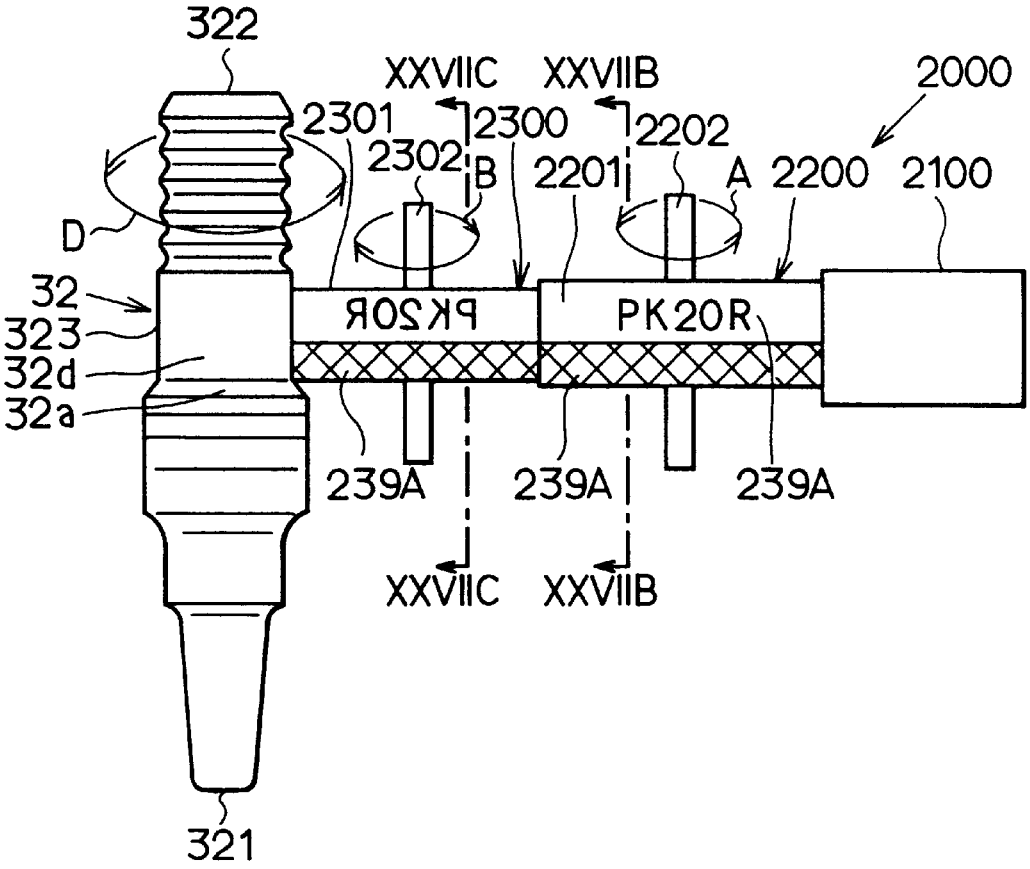
FIG. 27A is a front view showing a printing machine for forming the conductive layer utilized in the twelfth embodiment.

Next, a method of forming the conductive layer 239 and the display member H will be described referring to FIGS. 27A, 27B, 27C, and 28. In the twelfth embodiment, a printing machine 2000, the front view and the upper view of which are respectively shown in FIGS. 27A and 28, is used. The printing machine 2000 has a doctor blade (a conductive paste supplying apparatus) 2100, a marking roller 2200, a transfer roller 2300, and a cleaning roller 2400. The doctor blade 2100 stores a conductive paste 239A and supplies it to the marking roller 2200. The marking roller 2200 and the transfer roller 2300 respectively have cylindrically shaped roller portions 2201 and 2301 which are rotatably supported by rotational axes 2202 and 2203. The roller portions 2201 and 2301 are disposed to contact each other at the circumferences thereof as shown in FIG. 28. The contacting portion of the roller portions 2201 and 2301 at the circumferences thereof is substantially parallel to the rotational axes 2202 and 2302 thereof. The cleaning roller 2400 removes the conductive paste 239A clinging on the circumference of the roller portion 2301 of the transfer roller 2300.

Figure 27B:
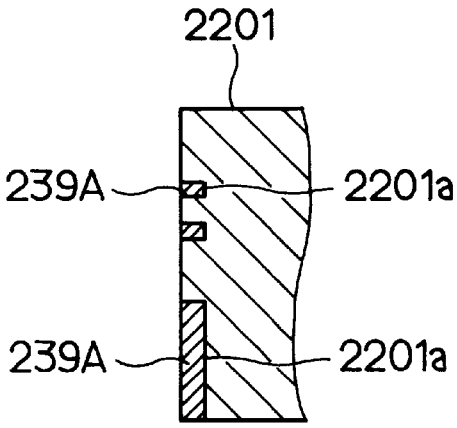
FIG. 27B is a cross-sectional view taken along a XXVIIB—XXVIIB line in FIG. 27A, showing a marking roller of the printing machine utilized in the twelfth embodiment.

The roller portion 2201 of the marking roller 2200 is made of metallic material such as iron, copper, or the like, and has recesses 2201*a* shown in FIGS. 27B and 28 corresponding to the second band-like portion 239*b* of the conductive layer 239 and the display member H. The recesses 2201*a* hold the conductive paste 239A therein. That is, the roller portion 2201 of the marking roller 2200 is an intaglio roller. The roller portion 2301 of the transfer roller 2300 is made of elastic material such as rubber, for example. The reference numeral 2500 shown in FIG. 28 denotes a paste removing member for removing extra conductive paste 239A held in the recesses 2201*a* of the roller portion 2201. The thus removed paste is stored in a storing portion 2501.

In processes for forming the conductive layer 129 and the display member H, first, $RuO_2$powder of 20 wt %, for example, borosilicate lead glass of 50 wt %, and binder material and a solvent of 30 wt % are mixed, thereby forming the conductive paste 239A. The conductive paste 239A is put in the doctor blade 2100. Next, a paste supplying portion 2101 of the doctor blade 2100 and the paste removing member 2500 are set to contact the circumference of the roller portion 2201 of the marking roller 2200. Further, the axial directions of the marking roller 2200, the transfer roller 2300, and the cleaning roller 2400 are set to be parallel to each other. The rotational direction A of the marking roller 2200 shown FIGS. 27A and 28 is set to a predetermined direction, and the rotational direction B of the transfer roller 2300 is set to the opposite direction of the rotational direction A of the marking roller 2200. The rotational direction C of the cleaning roller 2400 shown in FIG. 28 is set to be the same direction of the rotational direction A of the marking roller 2200.

In this state, in a paste supplying process, the conductive paste 239A is supplied from the paste supplying portion 2101 to the recesses 2201*a* of the marking roller 2200 rotating in the rotational direction A. The paste removing member 500 removes the extra paste of the conductive paste 239A held in the recesses 2201*a*, so that a specific amount of the conductive paste 239A is held in the recesses 2201*a*.

Figure 27C:
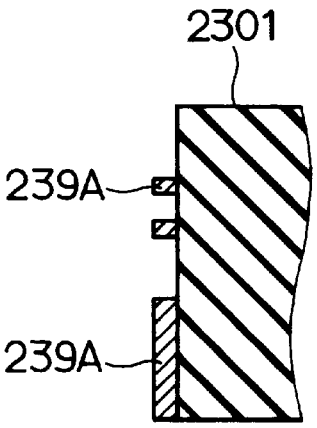
FIG. 27C is a cross-sectional view taken along a XXVIIC—XXVIIC line in FIG. 27A, showing a transfer roller of the printing machine utilized in the twelfth embodiment.

Thereafter, in a first coating process, the conductive paste 239A held in the recesses 2201*a* of the marking roller 2200 is transferred to the circumferential surface of the roller portion 2301 of the transfer roller 2300. At that time, because the roller portion 2301 is made of elastic material, the circumferential surface of the roller portion 2301 adheres to the circumferential surface of the roller portion 2201 biting into the recesses 2201*a*, so that, as shown in FIG. 27C, the conductive paste 239A held in the recesses 2201*a* is transferred to the circumferential surface of the roller portion 2301.

Here, the insulator 32 of the spark plug 503 is set so that the circumferential surface thereof contact the circumferential portion of the transfer roller 2300 in the state where the axial direction of the insulator 32 is parallel to the axial direction of the transfer roller 2300. Further, the rotational direction D shown in FIGS. 27A and 28 is set to be the opposite direction of the rotational direction B of the transfer roller 2300. Accordingly, in a transferring process, the conductive paste 239A transferred to the circumferential surface of the roller portion 2301 of the transfer roller 2300 is further transferred to the circumferential surface of the insulator 32. That is, the conductive paste 239A is transferred to (printed on) the extending portion 32*d* and the portion corresponding to the display member H of the insulator 32. The roller portion 2301 of the transfer roller 2300 functions as a rotating member as recited in the claims. After the conductive paste 239A is transferred to the insulator 32, the conductive paste 239A remaining on the circumferential surface of the roller portion 2301 of the transfer roller 2300 is securely removed by the cleaning roller 2400.

In the transferring process, the insulator 32 is disposed so that the extending portion 32*d* thereof is disposed on the upper side with respect to the ramp portion 32*a* thereof in the vertical direction. Further, the insulator is kept to be the same state for a specific time after the transferring process, whereby the conductive paste 239A printed on the extending portion 32*d* of the insulator 32 moves to the ramp portion 32*a* thereof due to its own weight. This is a moving process. Next, a glass-system insulating paste (not shown) is coated on the entire surface of the insulator 32 on the side of the end portion 322 thereof with respect to the ramp portion 32*a* in addition to being coated on the ramp portion 32*a*. The conductive paste 239A on the insulator 32 is covered with the glass-system insulating paste. The glass-system insulating paste includes, for example, $SiO_2$ (glass-system insulating material) of 45 wt %, PbO of 30 wt %, and $B_2O_3$ of 25 wt %, which are mixed with a solvent. Thereafter, in a burning process, the insulator 32 is heated in a furnace at a high temperature (for example, 800° C.) for a specific time (for example, 20 minutes), so that the conductive paste 239A and the glass-system insulating paste are burned. As a result, the conductive layer 239 and the display member H are formed on the insulator 32.

In the twelfth embodiment, although the conductive layer 239 includes $RuO_2$, it may include another material such as a resistor having a pyrochlore-type crystal structure, and the like in addition to $RuO_2$. Further, although the conductive layer 239 includes borosilicate lead glass, it may include borosilicate glass or the like. In the case where the conductive paste 239A includes resistive materials such as borosilicate glass, borosilicate lead glass and the like, it is desired that the conductive paste 239A is burned after being coated on the insulator 32.

In the twelfth embodiment, the conductive layer 239 and the display element H can be formed at the same time, thereby resulting in simplification of the manufacturing processes. Further, in the transferring process, the conductive paste 239A is printed only on the extending portion 32*d* and the portion corresponding to the display member H. Then, in the successive moving process, the conductive paste 239A on the extending portion 32*d* moves to cover the ramp portion 32*a* of the insulator 32. Therefore, the roller portion 3201 of the transfer roller 3200 need not have a ramp portion corresponding to the ramp portion 32*a* of the insulator 32, thereby resulting in low cost. In the moving process, the insulator 32 is disposed so that the extending portion 32*d* thereof is disposed on the upper side of the ramp portion 32*a* thereof in the vertical direction. In this case, the axial direction of the insulator 32 is generally parallel to the vertical direction. However, it is acceptable that the axial direction of the insulator is a little tilted with respect to the vertical direction.

In the transferring process, the conductive paste 239A may be printed on the ramp portion 32*a* of the insulator 32 along with on the extending portion 32*d* thereof. In this case, the moving process is unnecessary, so that the manufacturing processes of forming the conductive layer 239 can be simplified. To coat the conductive paste 239A on the extending portion 32*d* and on the ramp portion 32*a* at the same time, the roller portion 2301 of the transfer roller 2300 may have the ramp portion corresponding to the ramp portion 32*a* of the insulator 32 on the circumference thereof. Otherwise, the roller portion 2301 of the transfer roller 2300 may be made of elastic material to deform along the shape of the ramp portion 32*a* and the extending portion 32*d* of the insulator 32 in the transferring process. It is apparent that the above-mentioned method is applicable to the other conductive layers in the foregoing embodiments.

Thirteenth Embodiment

In a thirteenth preferred embodiment, in the processes for forming the conductive layer 239 shown in FIGS. 25 and 26, a printing machine 3000 shown in FIGS. 29A and 29B is used in place of the printing machine 2000 used in the twelfth embodiment. The printing machine 3000 has a transfer roller 3300 having a roller portion 3301, and the roller portion 3301 has paste holding portions 3301*a* on the circumferential surface thereof. The paste holding portions 3301*a* respectively has shapes corresponding to the second band-like portion 239*b* of the conductive layer 239 shown in FIG. 26 and the display member H, and protrudes from the circumferential surface of the roller portion 3301. That is, the roller portion 3301 of the transfer roller 3300 is a relief roller.

In the printing machine 3000, the marking roller 2200 and the cleaning roller 2400 shown in FIG. 17A in the twelfth embodiment are not utilized in the thirteenth embodiment. The conductive paste 239A is directly supplied to the transfer roller 3300 from a doctor blade 3100 to be attached on the paste holding portions 3301*a* of the transfer roller 3300. This is a coating process in which the conductive paste 239A is coated on the paste holding portions 3301*a* of the transfer roller 3300 to have shapes corresponding to the second band-like portion 239*b* of the conductive layer 239 and the display member H.

The insulator 32 is set to contact the circumferential surface of the roller portion 3301 of the transfer roller 3300, and the rotational direction D of the insulator 32 is set to be the opposite direction with respect to the rotational direction B of the roller portion 3301. Accordingly, in a transferring process, the conductive paste 239A attached on the paste holding portions 3301*a* of the transfer roller 3300 is transferred to (printed on) the circumferential surface of the insulator 32. That is, the conductive paste 239A is transferred to (printed on) the extending portion 32*d* and the portion corresponding to the display member H on the circumferential surface of the insulator 32. The successive processes in the thirteenth embodiment are similar to those in the twelfth embodiment and description thereof will be omitted.

Figure 30:
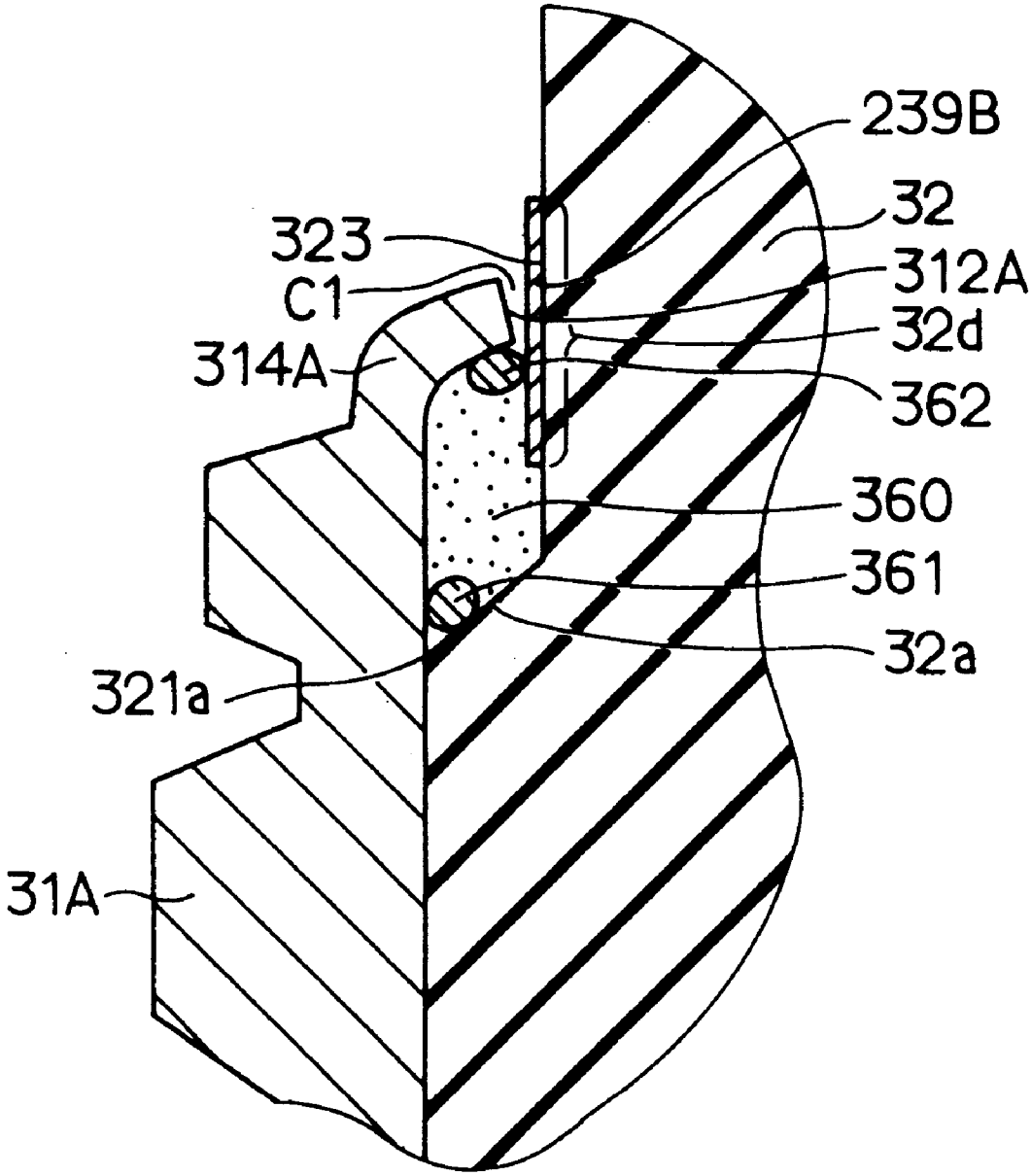
FIG. 30 is a partially enlarged cross-sectional view showing a conductive layer in a modified embodiment of the twelfth, thirteenth, and fourteenth embodiments.

Here, it is apparent that the above-mentioned processes in the twelfth and thirteenth embodiments are applicable to the other conductive layers. For example, the processes can be adopted to a conductive layer 239B shown in FIG. 30. In this case, as shown in FIG. 30, the same sealing structure between the insulator 32 and the metallic body 31A as in the fifth embodiment is employed. The detailed description of the sealing structure is described in the fifth embodiment. The conductive layer 239B is formed on the insulator 32 to face the end portion 312A of the metallic body 31A and to not cover the ramp portion 32*a* of the insulator 32. The conductive layer 239B also can be formed by the same processes as in the twelfth or thirteenth embodiment except the above-mentioned moving process which need not be applied to the conductive layer 239B.

Fourteenth Embodiment

Figure 31A:
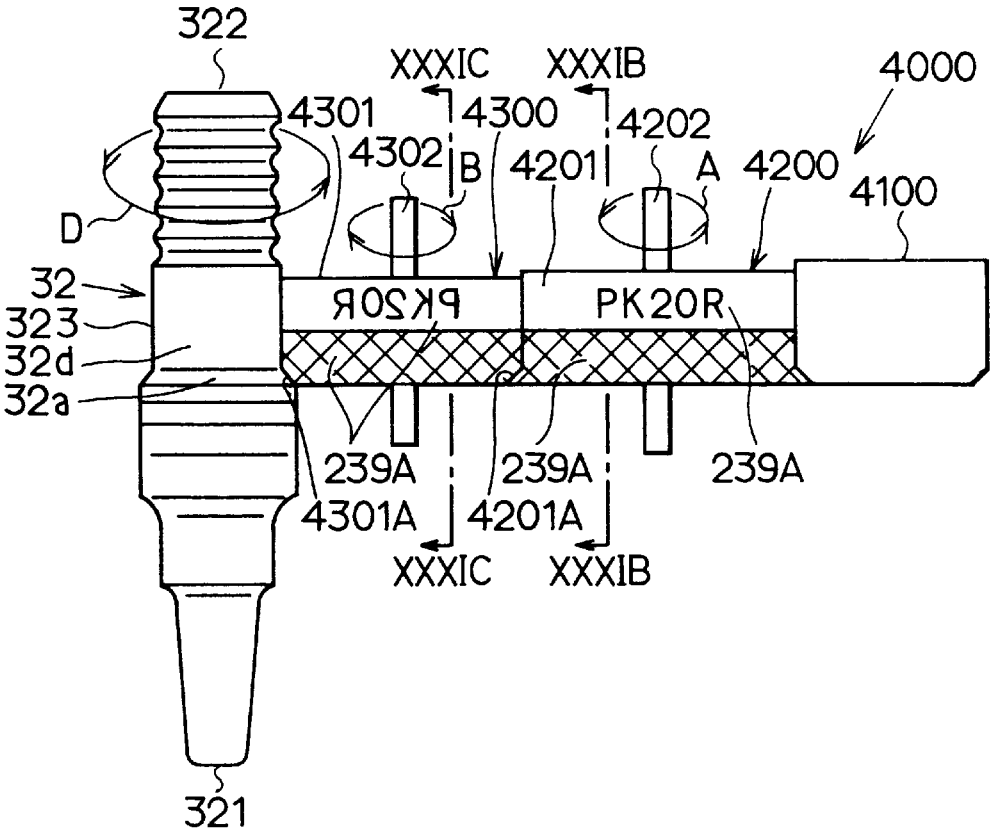
FIG. 31A is a front view showing a printing machine utilized in a fourteenth preferred embodiment according to the present invention.
Figure 31B:
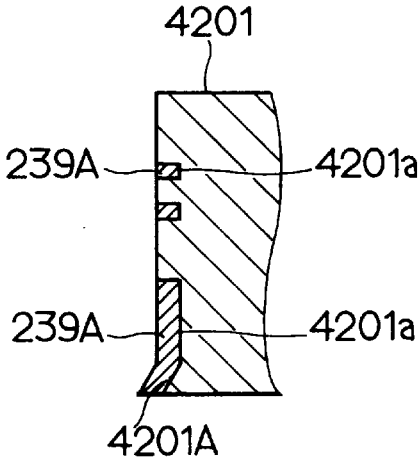
FIG. 31B is a cross-sectional view taken along a XXXIB—XXXIB line in FIG. 31A, showing a marking roller of the printing machine utilized in the fourteenth embodiment.
Figure 31C:
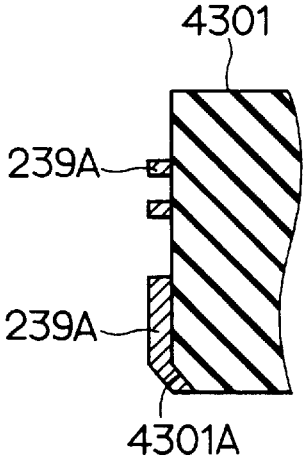
FIG. 31C is a cross-sectional view taken along a XXXIC—XXXIC line in FIG. 31A, showing a transfer roller of the printing machine utilized in the fourteenth embodiment.

In a fourteenth preferred embodiment, in the processes for forming the conductive layer 239 shown in FIGS. 25 and 26, a printing machine 4000 shown in FIGS. 31A, 31B and 31C is used in place of the printing machine 2000 used in the twelfth embodiment. The printing machine 4000 has a transfer roller 4300 having a roller portion 4301 having a ramp portion 4301A on the circumferential portion thereof to correspond to the ramp portion 32*a* of the insulator 32. A marking roller 4200 of the printing machine 4000 has a roller portion 4201 having a ramp portion 4201A on the circumferential portion thereof to correspond to the ramp portion 4301A of the transfer roller 4300. A doctor blade 4100 has the same structure as the doctor blade 2100 shown in FIG. 28 and can supply the conductive paste 239A to the marking roller 4200 without causing any failure. The paste removing member 2500 shown in FIG. 28 is applied to the printing machine 40000 to remove extra conductive paste 239A held in recesses 4201*a* formed on the circumferential portion of the roller portion 4201 of the marking roller 4200.

By using the printing machine 4000, in the above-mentioned transferring process, the conductive paste 239A is simultaneously transferred to the ramp portion 32*a* and the extending portion 32*d* of the insulator 32. Therefore, the moving process is not needed, so that the processes for forming the conductive layer 239 can be simplified. However, the roller portion 4301 of the transfer roller 4300 may have a sufficient length in the axial direction thereof without having the ramp portion 4301A thereof to elastically deform along the surfaces of the extending portion 32*c* and the ramp portion 32*a*. Accordingly, the conductive paste 239A can be transferred to the extending portion 32*d* and the ramp portion 32*a* of the insulator 32 at the same time as well. The processes in the twelfth, thirteenth and fourteenth embodiments are adopted to form the conductive layer 239 shown in FIGS. 25 and 26, however, they can be adopted to the other conductive layers in the above-mentioned embodiments.

Fifteenth Embodiment

Figure 32:
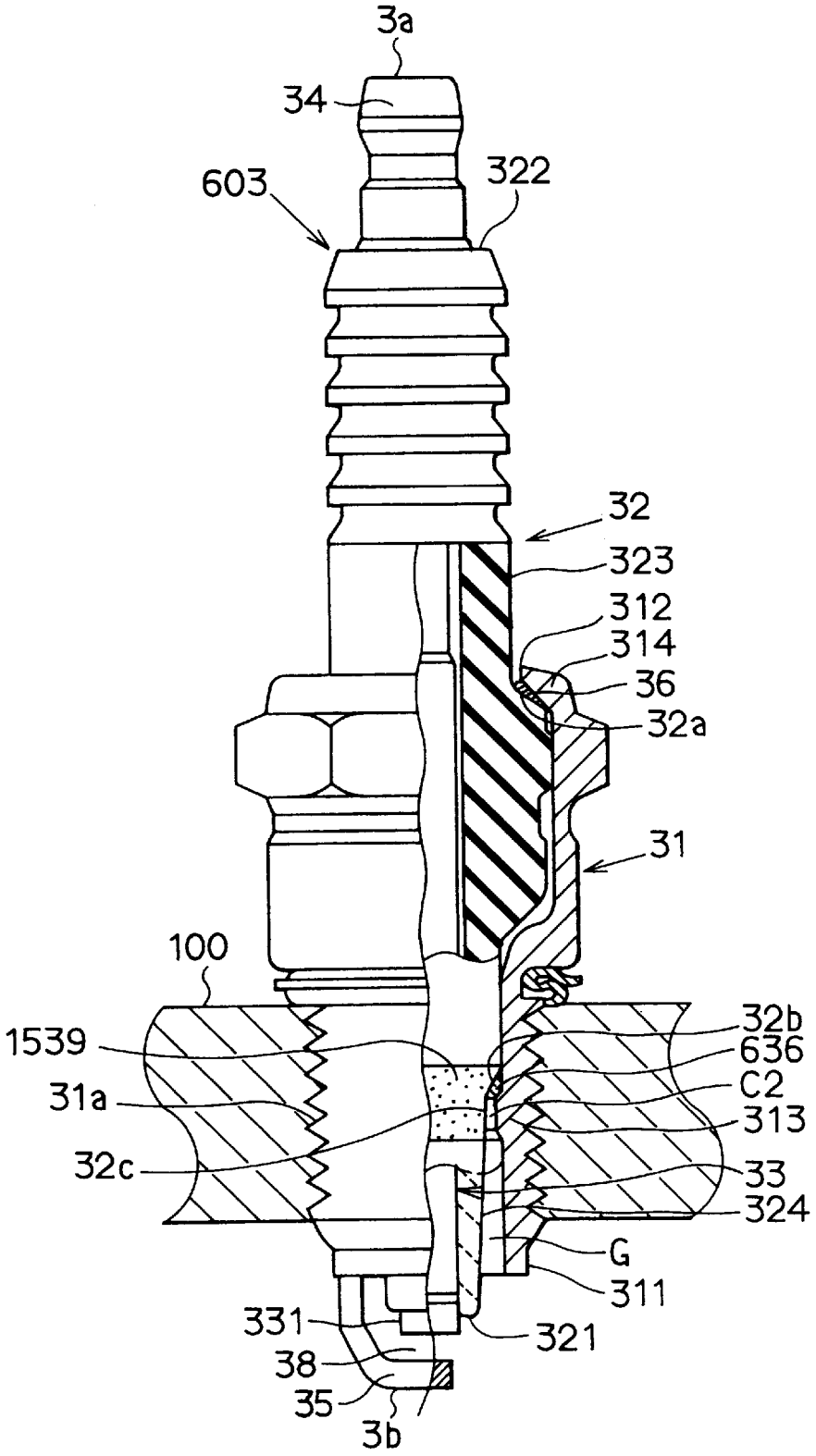
FIG. 32 is a partial cross-sectional view showing a spark plug in a fifteenth preferred embodiment according to the present invention.

A spark plug in a fifteenth preferred embodiment is shown in FIG. 32. In the spark plug 603, a conductive layer 1539 is formed on a specific portion of the insulator 32 to face the supporting portion 313 of the metallic body 31 and the vicinity thereof. The specific portion of the insulator 32 includes the ramp portion 32*b* and the extending portion 32*c* provided on the side of the clearance C2 with respect to the ramp portion 32*b*. Here, the diameter of the small diameter portion 324 of the insulator 32 becomes smaller as it becomes closer to the end portion 321 of the insulator 32, and the extending portion 32*c* is formed on the small diameter portion 324. Therefore, the lengthwise direction of the circumferential surface of the extending portion 32*c* is a little tilted with respect to the axial direction of the insulator 32.

A printing machine 5000 used in the fifteenth embodiment shown in FIG. 34 has a doctor blade 5100 and a transfer roller 5300. The transfer roller 5300 has a roller portion 5301 made of elastic material. The length of the roller portion 5301 in the axial direction thereof is approximately equal to the length of the extending portion 32*c* in the lengthwise direction thereof. In the processes for forming the conductive layer 1539, the insulator 32 is, as shown in FIG. 34, vertically set so that the extending portion 32*c* thereof is disposed on the upper side of the ramp portion 32*a* thereof and so that the axial direction of the insulator 32 is approximately parallel to the axial direction of the transfer roller 5300.

In a coating process, a conductive paste 1539A is supplied from the doctor blade 5100 to the entire circumferential surface of the roller portion 5301 of the transfer roller 5300. Next, in a transferring process, the thus coated conductive paste 1539A on the roller portion 5301 is transferred to the extending portion 32*c* of the insulator 32. In this process, the roller portion 5301 of the transfer roller 5300 elastically deforms along the surface of the extending portion 32*c*. Therefore, the conductive paste 1539A can be uniformly transferred to the entire surface of the extending portion 32*c* of the insulator 32. Thereafter, in a moving process, a part of the conductive paste 1539A is moved to cover the ramp portion 32*b* by its own weight. The other features are similar to those in the above mentioned embodiments. The conductive paste 1539A may be made of the same material as the conductive paste 239A. In the above-mentioned embodiments, it is not always necessary to employ the packings 36 and 636 shown in FIGS. 25, 32, and the like. The corners of the end portion 312 of the metallic body 31 can be rounded to suppress the concentration of electric field therearound.

Sixteenth Embodiment

Figure 35:
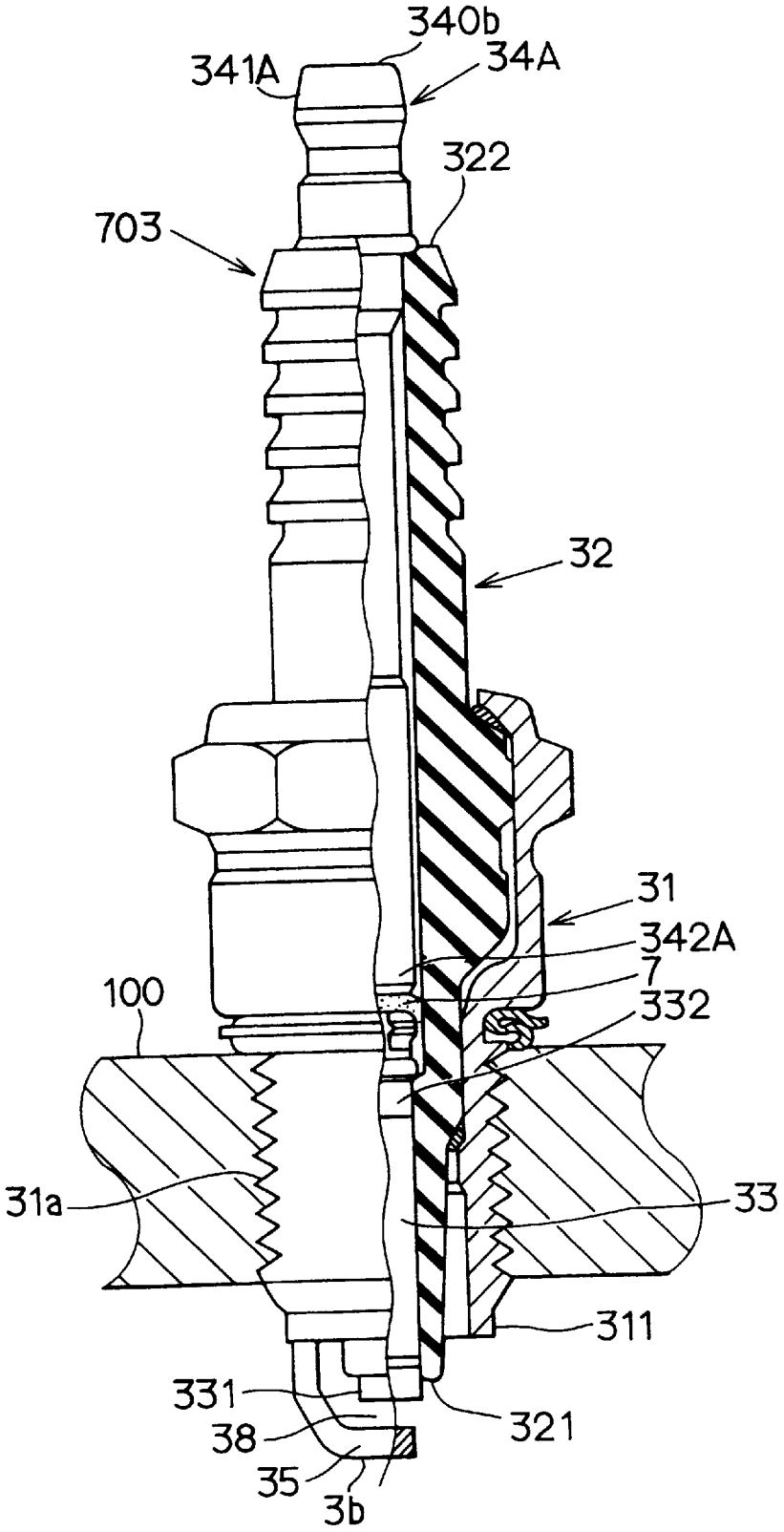
FIG. 35 is a partial cross-sectional view showing a spark plug in a sixteenth preferred embodiment according to the present invention.
Figure 36:
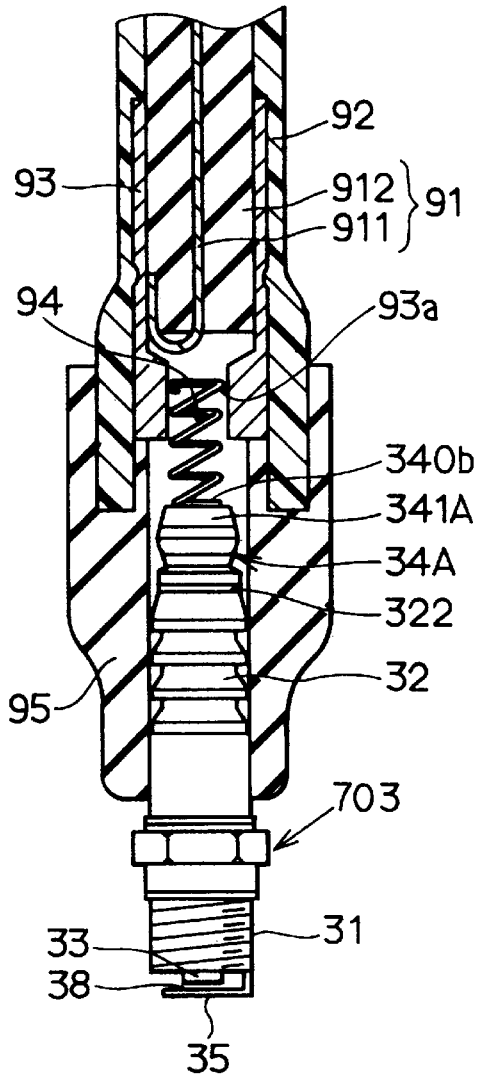
FIG. 36 is a cross-sectional view showing an electrical-connection structure of the spark plug to an ion current detecting apparatus in the sixteenth embodiment.

A spark plug 703 in a sixteenth preferred embodiment are shown in FIG. 35. The parts and components similar to those in the above-mentioned embodiments are shown by the same reference numerals and description thereof will be omitted. In the spark plug 703, a stem portion 34A has an end portion 342A fixed to the end portion 332 of the center electrode 33 through a thermal fusing member 7 made of copper glass or the like to electrically communicate with each other within the insulator 32. Further, the stem portion 34A is connected to the ion current detecting apparatus 10 in the same way as in the above-mentioned embodiments. That is, as shown in FIG. 36, the stem portion 34A is electrically connected to the lead wire 91 connected to the ion current detecting apparatus 10 through the coil spring 94 and the conductive cylinder 93. The coil spring 94 contacts the end surface 340*b* of the stem portion 34A formed on the other end portion 341A thereof.

Figure 37:
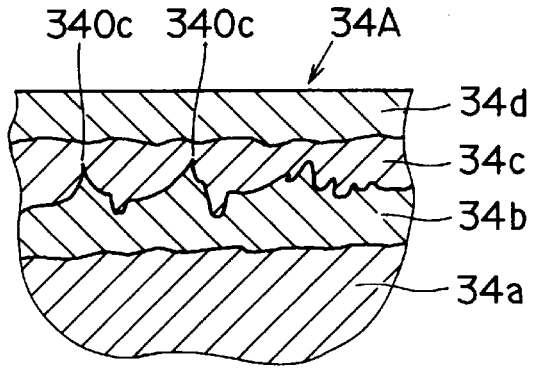
FIG. 37 is a partially enlarged cross-sectional view showing a stem portion at an end surface thereof in the sixteenth embodiment.

As shown in FIG. 37, the stem portion 34A at the end surface 340*b* thereof is composed of a body member 34*a* made of an iron system material, a corrosion-proof conductive layer 34*b* formed on the body member 34*a* and made of conductive material such as nickel or the like, and a conductive layer 34*d* made of conductive material such as gold, silver, aluminum, or the like. Further, an insulating oxidized layer 34*c* made of oxidized material such as NiO or the like, which is undesirablly formed in the process for forming the spark plug 703, is interposed between the corrosion-proof conductive layer 34*b* and the conductive layer 34*d*. The other portion of the stem portion 34A does not have the conductive layer 34*d* thereon.

Next, the method for forming the stem portion 34A will be explained. First, the stem portion 34A only having the body member 34*a* and the corrosion-proof conductive layer 34*b* is prepared in advance. Thereafter, the center electrode 33, copper glass in a powdery state, and the stem portion 34A are inserted into the insulator 32 in that order, and are temporarily assembled, thereby forming a temporarily assembled body. The thus formed temporarily assembled body is put in a furnace at a high temperature (for example, 800° C.–900° C.) for approximately 1 hour in an air atmosphere so that the copper glass is fused. As a result, the stem portion 34A and the center electrode 33 are fixed to each other through the thermal fusing member 7. At the same time, a surface portion of the corrosion-proof conductive layer 34*b* is oxidized, so that the insulating oxidized layer 34*c* is formed on the corrosion-proof conductive layer 34*b*. Thereafter, a conductive paste containing the conductive material for the conductive layer 34*d* and a solvent is coated on the end surface 340*b* of the stem portion 34A and is dried, so that the conductive layer 34*d* is formed only on the end surface 340*b* of the stem portion 34A. The thickness of the conductive layer 34*d* is, for example, approximately 5 μm.

Thereafter, the lead wire 91 is connected to the end portion 341A of the stem portion 34A through the coil spring 94 and the conductive cylinder 93 so that the coil spring 94 contacts the end surface 340*b* of the stem portion 34A. The diameter of the coil spring 94 is smaller than that of the end surface 340*b* of the stem portion 34A. The portion of the end surface 340*b* of the stem portion 34A which the coil spring 94 contacts is hereinafter called a specific ring-shaped portion, and the specific ring-shaped portion has the same diameter as that of the coil spring 94. The conductive cylinder 93 has several (two or three) protrusions 93*a* on the inside surface thereof and the coil spring 94 is engaged with the protrusions 93*a* of the conductive cylinder 93 on the opposite side of the stem portion 34A. As a result, the coil spring 94 is disposed between the end surface 340*b* of the stem portion 34 and the conductive cylinder 93 to have an elastic force.

In the sixteenth embodiment, the conductive layer 34*d* is formed on the end surface 340*b* of the stem portion 34A to cover the specific ring-shaped portion thereof which the spring coil 94 contacts. As mentioned above, the insulating oxidized layer 34*c* is undesirablly formed in the heating process. The oxidized layer 34*c* is undesirable to obtain the electrical contact between the stem portion 34A and the coil spring 94. The thickness of the oxidized layer 34*c* is generally 5 μm–10 μm; however, the thickness is not uniform. As shown in FIG. 37, the oxidized layer 34*c* has sprinkled thin portions 340*c*, the thickness of each of which is 1 μm–2 μm. Dielectric breakdown easily occurs at the thin portions 340*c* of the oxidized layer 34*c*, however, it hardly occurs at the other portions of the oxidized layer 34*c*. Therefore, if the coil spring 94 is directly disposed on the oxidized layer 34*c* of the end surface 340*b* without having the conductive layer 34*d* thereon, because the area of the end surface 340*b* which the coil spring 94 contacts is small, the spring coil 94 is difficult to always contact the thin portions 340*c* of the oxidized layer 34*c*. Therefore, it is difficult for the coil spring 94 to securely and electrically communicate with the stem portion 34A.

As opposed to this, in the sixteenth embodiment, the conductive layer 34*d* is formed on the entire end surface 340*b* of the stem portion 34A to securely cover the specific ring-shaped portion thereof which the spring coil 94 contacts. In this case, the conductive layer 34*d* contacts the thin portions 340*c* of the oxidized layer 34*c* without fail, so that the coil spring 94 can be securely and electrically connected to the body member 34*a* of the stem portion 34A through the corrosion-proof conductive layer 34*b*, the thin portions 340*c* of the oxidized layer 34*c* and the conductive layer 34*d*. Accordingly, the ion current detecting apparatus can securely detect the ion current of the spark plug 703, so that the burning state of the air-fuel mixture in the combustion chamber can be accurately judged.

In the seventeenth embodiment, the oxidized insulating layer 34*c* of the stem portion 34A is formed in the above-mentioned heating process, there is possibility that the oxidized insulating layer 34*c* is formed in the other processes, for example, in the process that the insulator 32 is coated with a glaze after being temporarily assembled and is heated.

In the sixteenth embodiment, although the conductive layer 34*d* is formed entirely on the end surface 340*b* of the stem portion 34, it may be formed partially on the end surface 340*b* thereof. For example, the conductive layer 34*d* may not be formed on the inside area of the specific ring-shaped portion of the end surface 340*b*, and it may be formed on the half area of the end surface 340*b*. In every case that the conductive layer 34*d* covers a part of the specific ring-shaped portion to which the coil spring 94 contacts, the coil spring 94 can be securely and electrically connected to the stem portion 34. In such cases, it is desired that the conductive layer 34*d* be formed on the area of 15% of the end surface 340*b* to cover a part of the specific ring-shaped portion. This was obtained from the results of the experiment performed on the conductive layers 34*d* having various areas.

In the sixteenth embodiment, the diameter of the coil spring 94 is smaller than that of the end surface 340*b* of the stem portion 34A. However, the diameter of the coil spring 94 may be larger than that of the end surface 340*b* of the stem portion 34A and the coil spring 94 may be put around the stem portion 34A at the end portion 341A thereof. In this case, it is necessary that the conductive layer 34*d* is formed on the circumferential surface of the end portion 341A of the stem portion 34A on which the coil spring 94 is disposed.

The electrical-connection structure of the stem portion 34A and the lead wire 91 is not limited to the above-mentioned structure shown in FIG. 36, and it is not always necessary to adopt the coil spring 94 therein. For example, the conductive cylinder 93 can have a protruding portion extending to the side of the stem portion 34A so as to abut the circumferential surface of the stem portion 34A so that the electrical contact between the stem portion 34A and the lead wire 91 is obtained. A plate spring generally having an S-shape, an L-shape, or the like may be adopted in place of the coil spring 94. A disk-like member made of conductive material may be disposed between the coil spring 94 and the end surface 340*b* of the stem portion 34A. A resistor can be disposed between the center electrode 33 and the stem portion 34A to prevent radio frequency noise produced by the spark discharge of the spark plug 703 from passing to electrical machinery and apparatuses such as radios and the like.

The conductive layer 34*d* of the stem portion 34A desirably includes to include at least one of gold, silver, aluminum, nickel, and chromium. These materials have corrosion resistance and oxidation resistance at the temperature (for example, approximately 200° C.) in the operated state of the spark plug 703. Further, the thickness of the conductive layer 34*d* is desired to be thicker than lam. If it is thinner than 1 $\mu$m, it is difficult that the coil spring 94 and the stem portion 34A are securely and electrically connected to each other through the oxidized layer 34*c* and the conductive layer 34*d* of the stem portion 34A at the end surface 340*b* thereof.

The corrosion-proof conductive layer 34*b* is desired to include at least one of nickel, chromium, silver, and zinc.

These materials have corrosion resistance and oxidation resistance at the temperature (for example, approximately 200° C.) in the operated state of the spark plug 703. The thickness of the corrosion-proof conductive layer 34*b* is desired to be in a range of 1 $\mu$m to 200 $\mu$m. If it is thinner than 1 $\mu$m, the corrosion-proof conductive layer cannot sufficiently prevent the corrosion of the body member 34*a*. If it is thicker than 200 $\mu$m, the process for forming the corrosion-proof conductive layer 34*c* by an electrical galvanizing method or the like needs much time, thereby resulting in high cost.

While the present invention has been shown and described with reference to the foregoing preferred embodiment, it will be apparent to those skilled in the art that changes in form and detail may be made therein without departing from the scope of the invention as defined in the appended claims.

What is claimed is:

1. A spark plug for an apparatus for detecting an ion current produced by the spark plug, the spark plug comprising:

a generally cylindrically shaped metallic body having first and second metallic body ends;

a generally cylindrically shaped insulator having first and second insulator ends and held in the metallic body in a state where the first insulator end protrudes from the first metallic body end;

a filling layer filling at least one space provided between an outside surface of the insulator and at least one of the first metallic body end and the second metallic body end, the filling layer substantially prohibiting arcing between the insulator and said at least one of the first metallic body end and the second metallic body end;

a center electrode held in the insulator to expose an end thereof from the second insulator end; and a ground electrode facing the end of the center electrode to define a gap to produce an ion current in the gap.

2. A spark plug according to claim 1, wherein the filling layer is made of a material having a higher dielectric constant and a higher dielectric strength than a dielectric constant and a dielectric strength of air.

3. A spark plug according to claim 2, wherein the filling layer is made of a material selected from an insulating resin material and an insulating fat and oil material.

4. A spark plug according to claim 3, wherein the filling layer is made of a material selected from group consisting of silicone resin, fluororesin, and epoxy resin.

5. A spark plug according to claim 3, wherein the filling layer is made of a material selected from a group of consisting of silicone oil, fluorine-contained oil, turbine oil, rustproof oil, lubricating oil, diphenyl chloride system oil and sulfonic system oil.

6. A spark plug according to claim 1, wherein the filling layer is made of a conductive material.

7. A spark plug according to claim 6, wherein the filling layer has a resistance in a range of $10^5$ to $10^{10}$ Ω per square inch when a thickness of the filling layer is 20 $\mu$m.

8. A spark plug for an apparatus for detecting an ion current produced by the spark plug, the spark plug comprising:

a substantially cylindrically shaped metallic body having first and second metallic body ends and a supporting portion protruding inwardly in a radial direction thereof between the first and second metallic body ends;

a substantially cylindrically shaped insulator having first and second insulator ends and a ramp portion on an outside surface thereof between the first and second insulator ends, and held in the metallic body in a state where the ramp portion thereof is supported by the supporting portion of the metallic body;

a conductive layer including a first portion provided on the ramp portion of the insulator and a second portion extending from the first portion to face the supporting portion of the metallic body with a gap defined therebetween;

a center electrode held in the insulator to expose an end thereof from the second insulator end; and a ground electrode facing the end of the center electrode to define a gap with the center electrode to produce an ion current in the gap.

9. A spark plug according to claim 8, wherein:

the supporting portion of the metallic body includes the first metallic body end;

the insulator on a first insulator end side with respect to the ramp portion thereof protrudes from the first metallic body end; and the conductive layer fills a gap between the first metallic body end and the outside surface of the insulator.

10. A spark plug according to claim 8, wherein the conductive layer has a resistance in a range of $10^5$ to $10^{10}$ Ω per square inch when a thickness of the conductive layer is 20 μm.

11. A spark plug according to claim 8, wherein the conductive layer is electrically connected to the metallic body.

12. A spark plug according to claim 8, wherein the conductive layer encircles the outside surface of the insulator.

13. A spark plug according to claim 8, wherein the conductive layer includes a conductive material and a glass material.

14. A spark plug for detecting an ion current produced by the spark plug the spark plus comprising:

a substantially cylindrically shaped metallic body having first and second metallic body ends and a supporting portion protruding inwardly in a radial direction thereof between the first and second metallic body ends;

a substantially cylindrically shaped insulator having first and second insulator ends and a ramp portion on an outside surface thereof between the first and second insulator ends, and held in the metallic body in a state where the ramp portion thereof is supported by the supporting portion of the metallic body;

a protection layer provided on the outside surface of the insulator to face the supporting portion of the metallic body;

a center electrode held in the insulator to expose an end thereof from the second insulator end; and a ground electrode facing the end of the center electrode to define a gap with the center electrode to produce the ion current in the gap, wherein the supporting portion of the metallic body includes the first metallic body end;

the insulator on a first insulator end side with respect to the ramp portion thereof protrudes from the first metallic body end; and the protection layer fills a gap between the first metallic body end and the outside surface of the insulator, wherein the protection layer is a conductive layer including conductive material.

15. A spark plug according to claim 14, wherein the conductive layer has a resistance in a range of $10^5$ Ω to $10^{10}$ Ω per square inch when the thickness thereof is approximately 20 μm.

16. A spark plug for an apparatus for detecting an ion current produced by the spark plug, the spark plug comprising:

a substantially cylindrically shaped metallic body having first and second metallic body ends and a supporting portion protruding inwardly in a radial direction thereof between the first and second metallic body ends;

a substantially cylindrically shaped insulator having first and second insulator ends and a ramp portion on an outside surface thereof between the first and second insulator ends, and held in the metallic body in a state where the ramp portion thereof is supported by the supporting portion of the metallic body;

a protection layer provided on the outside surface of the insulator to face the supporting portion of the metallic body;

a center electrode held in the insulator to expose an end thereof from the second insulator end; and a ground electrode facing the end of the center electrode to define a gap with the center electrode to produce the ion current in the gap, wherein:

the supporting portion of the metallic body includes the first metallic body end;

the insulator on a first insulator end side with respect to the ramp portion protrudes from the first metallic body end; and the protection layer is a conductive layer including a conductive material and faces the first metallic body end.

17. A spark plug according to claim 16, wherein the conductive layer has a resistance in a range of $10^5$ Ω to $10^{10}$ Ω per square inch when the thickness thereof is approximately 20 μm.

18. A spark plug according to claim 17, wherein the conductive layer has a resistance in a range of $10^6$ Ω to $10^9$ Ω per square inch when the thickness thereof is approximately 20 μm.

19. A spark plug according to claim 16, wherein the conductive layer includes a glass-system insulating material.

20. A spark plug according to claim 19, wherein the insulator has an insulating layer thereon on the first insulator end side thereof with respect to the conductive layer.

21. A spark plug according to claim 16, wherein the conductive layer has an extending portion extending from a portion corresponding to the first metallic body end toward the first insulator end by a specific length in an axial direction of the insulator.

22. A spark plug according to claim 21, wherein the specific length of the extending portion of the conductive layer is more than 2 mm.

23. A spark plug according to claim 21, wherein an end of the extending portion of the conductive layer on the first insulator end side is covered with an insulating member.

24. A spark plug according to claim 16, wherein the conductive layer is provided on the outside surface of the insulator to encircle the insulator.

25. A spark plug according to claim 21, wherein the conductive layer is electrically connected to the metallic body.

26. A spark plug according to claim 21, wherein the conductive layer is provided on the ramp portion of the insulator.

27. A spark plug according to claim 26, wherein the conductive layer is provided on a portion of the insulator extending from the ramp portion toward the second insulator end by a specific length.

28. A spark plug for an apparatus for detecting an ion current produced by the spark plug, the spark plug comprising:

a substantially cylindrically shaped metallic body having first and second metallic body ends and a supporting portion protruding inwardly in a radial direction thereof between the first and second metallic body ends;

a substantially cylindrically shaped insulator having first and second insulator ends and a ramp portion on an outside surface thereof between the first and second insulator ends, and held in the metallic body in a state where the ramp portion thereof is supported by the supporting portion of the metallic body;

a protection layer provided on the outside surface of the insulator to face the supporting portion of the metallic body;

a center electrode held in the insulator to expose an end thereof from the second insulator end; and a ground electrode facing the end of the center electrode to define a gap with the center electrode to produce the ion current in the gap, wherein:

the insulator has a small diameter portion on a second insulator end side with respect to the ramp portion thereof, the small diameter portion having a diameter smaller than that of the other portion of the insulator on an opposite side of the small diameter portion with respect to the ramp portion; and the protection layer is a conductive layer including conductive material and is provided on the small diameter portion of the insulator.

29. A spark plug according to claim 28, wherein the conductive layer has a resistance in a range of $10^5$ Ω to $10^{10}$ Ω per square-inch when the thickness thereof is approximately 20 μm.

30. A spark plug according to claim 29, wherein the conductive layer has a resistance in a range of $10^6$ Ω to $10^9$ Ω per square inch when the thickness thereof is approximately 20 μm.

31. A spark plug according to claim 28, wherein the conductive layer includes a glass-system insulating material.

32. A spark plug according to claim 28, wherein the conductive layer electrically communicates with the metallic body.

33. A spark plug according to claim 28, wherein the conductive layer is provided on the ramp portion of the insulator.

34. A spark plug according to claim 33, wherein the conductive layer is provided on a portion of the insulator extending from the ramp portion toward the first insulator end by a specific length.

35. A spark plug for an apparatus for detecting an ion current produced by the spark plug, the spark plug comprising:

an insulator having a cylindrical shape with first and second insulator ends and a ramp portion on a second insulator end side to have a small diameter portion on the second insulator end side with respect the ramp portion, the small diameter portion having a diameter smaller than that of the insulator on an opposite side of the small diameter portion with respect to the ramp portion;

a metallic body having a cylindrical shape with first and second metallic body ends and a supporting portion protruding inwardly in a radial direction thereof, the metallic body which holds the insulator therein in a state where the supporting portion thereof faces the small diameter portion of the insulator to make a space having a width of more than 0.5 mm in a radial direction of the insulator and supports the ramp portion of the insulator;

a center electrode held in the insulator to expose an end thereof from the second insulator end; and a ground electrode facing the end of the center electrode to define a gap with the center electrode to produce the ion current in the gap.

36. A spark plug according to claim 35, wherein an overlapped width of the supporting portion of the metallic body and the ramp portion of the insulator in the radial direction of the insulator is more than three tenths of a width of the ramp portion in the radial direction of the insulator.

37. A spark plug according to claim 35, wherein the width of the space between the supporting portion of the metallic body and the small diameter portion of the insulator in the radial direction of the insulator is more than 0.6 mm.

38. A spark plug according to claim 35, wherein the insulator has a conductive layer formed on the small diameter portion thereof to face the supporting portion of the metallic body.

39. A spark plug according to claim 38, wherein the conductive layer is formed on the ramp portion of the insulator.

40. A spark plug for an ion current detecting apparatus, the spark plug comprising:

a center electrode having first and second ends;

a ground electrode facing the first end of the center electrode to define a discharge with the center electrode to produce an ion current in the gap;

a stem portion having a first end face electrically communicating with the second end of the center electrode and a second end face;

a conductive layer provided on the second end face of the stem portion; and a connecting member electrically connected to the center electrode through the conductive layer for electrically connecting the center electrode to the ion current detecting apparatus.

41. A spark plug according to claim 40, wherein an area of the conductive layer formed on the second end face of the stem portion overlaps with a contacting area of the second end face which the connecting member contacts.

42. A spark plug according to claim 40, wherein an area of the conductive layer formed on the second end face of the stem portion is larger than a contacting area of the second end face which connecting member contacts.

43. A spark plug according to claim 40, wherein the conductive layer is made of material selected at least one form a group consisting of gold, silver, aluminum, nickel, and chromium.

44. A spark plug according to claim 40, wherein the conductive layer has a thickness of more than 1 μm.

45. A spark plug according to claim 40, wherein the stem portion has a corrosion-proof conductive layer on an outside surface thereof, and the conductive layer is formed on the second end face of the stem portion through the corrosion-proof conductive layer.

46. A spark plug according to claim 45, wherein the corrosion-proof conductive layer is made of material selected at least one from a group consisting of nickel, chromium, silver, and zinc.

47. A spark plug according to claim 45, wherein the corrosion-proof conductive layer has a thickness in a range of 1 μm to 200 μm.

48. A spark plug according to claim 40, wherein the connecting member has an end portion connected to the second end face of the stem portion and the end portion of the connecting member is an elastic member.

49. A spark plug according to claim 48, wherein the connecting member is a coil spring.

50. A spark plug comprising:

a generally cylindrically shaped metallic body having first and second metallic body ends;

a generally cylindrically shaped insulator having first and second insulator ends and disposed in the metallic body with the first insulator end protruding from the first metallic body end;

a center electrode disposed in the insulator to expose an end thereof from the second insulator end;

a ground electrode facing the end of the center electrode to define a gap for producing an ion current in the gap; and a conductive layer disposed on an outside surface of the insulator to face at least one of the first and second metallic body ends and to be electrically connected to the metallic body.

51. A spark plug according to claim 50, wherein the conductive layer has a resistance in a range of $10^5$ to $10^{10}$ Ω per square inch when a thickness of the conductive layer is 20 μm.

52. A spark plug according to claim 51, wherein the resistance is in a range of $10^6$ to $10^9$ Ω per square inch when a thickness of the filling layer is 20 μm.

53. A spark plug according to claim 50, wherein:

the conductive layer has a first portion and a second portion extending from the first portion on the outside surface in an axial direction of the insulator;

the conductive layer faces the metallic body only at the first portion; and the second portion of the conductive layer has a length equal to or larger than 2 mm in the axial direction of the insulator.

54. A spark plug according to claim 53, wherein the second portion of the conductive layer is covered with an insulation layer.

55. A spark plug according to claim 53, further comprising an insulating cap covering the first insulator end and an end of the second portion of the conductive layer.

56. A spark plug according to claim 55, wherein the insulating cap covers the end of the second portion of the conductive layer at an entire circumference of the insulator.

57. A spark plug according to claim 50, wherein the conductive layer encircles the outside surface of the insulator.

58. A spark plug according to claim 10, wherein the resistance is in a range of $10^6$ to $10^9$ Ω per square inch when the thickness of the filling layer is 20 μm.

* * * * *